US010587034B2

(12) United States Patent
Zimmerman et al.

(10) Patent No.: US 10,587,034 B2
(45) Date of Patent: Mar. 10, 2020

(54) BASE STATION ANTENNAS WITH LENSES FOR REDUCING UPWARDLY-DIRECTED RADIATION

(71) Applicant: CommScope Technologies LLC, Hickory, NC (US)

(72) Inventors: Martin L. Zimmerman, Chicago, IL (US); Peter J. Bisiules, LaGrange Park, IL (US); Hangsheng Wen, Suzhou (CN); Zhiqing Zheng, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 53 days.

(21) Appl. No.: 15/876,546

(22) Filed: Jan. 22, 2018

(65) Prior Publication Data

US 2019/0103660 A1 Apr. 4, 2019

Related U.S. Application Data

(60) Provisional application No. 62/565,284, filed on Sep. 29, 2017, provisional application No. 62/593,425, filed on Dec. 1, 2017.

(51) Int. Cl.
*H01Q 1/24* (2006.01)
*H01Q 21/24* (2006.01)
(Continued)

(52) U.S. Cl.
CPC ..... *H01Q 1/246* (2013.01); *H01Q 3/2664* (2013.01); *H01Q 15/08* (2013.01); *H01Q 15/14* (2013.01);
(Continued)

(58) Field of Classification Search
CPC ..... H01Q 1/246; H01Q 25/008; H01Q 21/30; H01Q 25/005; H01Q 15/14; H01Q 15/08;
(Continued)

(56) References Cited

U.S. PATENT DOCUMENTS 3,781,900 A 12/1973 Fuller et al.
5,771,017 A 6/1998 Dean et al.
(Continued)

FOREIGN PATENT DOCUMENTS

CN 2729936 Y 9/2005
DE 4430832 A1 11/1995
(Continued)

OTHER PUBLICATIONS

U.S. Appl. No. 15/679,450, filed Aug. 17, 2017; Inventor: Martin L. Zimmerman; Entitled: Small Cell Beam-Forming Antennas.
(Continued)

*Primary Examiner* — Hai V Tran
(74) *Attorney, Agent, or Firm* — Myers Bigel, P.A.

(57) ABSTRACT

A base station antenna includes a radiating element that extends forwardly from a backplane and that is configured to transmit and receive signals in the 5.15-5.25 GHz frequency band and a radio frequency lens that is mounted forwardly of the radiating element. The RF lens is configured to re-direct a portion of an RF signal emitted by the radiating element downwardly so that a first peak emission of RF energy through a combination of the radiating element and the RF lens at elevation angles that are greater than 30° from a boresight pointing direction of the radiating element is less than a second peak emission of RF energy through the combination of the radiating element and the RF lens at elevation angles that are less than −30° from the boresight pointing direction of the radiating element.

20 Claims, 20 Drawing Sheets

(51) Int. Cl.

| | |
|---|---|
| ***H01Q 19/06*** | (2006.01) |
| ***H01Q 19/10*** | (2006.01) |
| ***H01Q 21/08*** | (2006.01) |
| ***H01Q 15/14*** | (2006.01) |
| ***H01Q 17/00*** | (2006.01) |
| ***H01Q 3/26*** | (2006.01) |
| ***H01Q 21/30*** | (2006.01) |
| ***H01Q 25/00*** | (2006.01) |
| ***H01Q 15/08*** | (2006.01) |

(52) U.S. Cl.
CPC ..... *H01Q 17/001* (2013.01); *H01Q 19/06* (2013.01); *H01Q 19/10* (2013.01); *H01Q 19/106* (2013.01); *H01Q 19/108* (2013.01); *H01Q 21/08* (2013.01); *H01Q 21/245* (2013.01); *H01Q 21/30* (2013.01); *H01Q 25/005* (2013.01); *H01Q 25/008* (2013.01)

(58) Field of Classification Search
CPC .... H01Q 17/001; H01Q 21/08; H01Q 3/2664; H01Q 19/108; H01Q 19/106; H01Q 1/24; H01Q 19/06; H01Q 21/24
USPC ..... 343/755
See application file for complete search history.

(56) References Cited

U.S. PATENT DOCUMENTS

| | | | | |
|---|---|---|---|---|
| 5,821,908 | A | 10/1998 | Sreenivas | |
| 5,923,296 | A | 7/1999 | Sanzgiri et al. | |
| 6,301,476 | B1 | 10/2001 | Monte et al. | |
| 6,323,817 | B1 | 11/2001 | Ramanujam et al. | |
| 6,426,814 | B1 | 7/2002 | Berger et al. | |
| 7,671,820 | B2 | 3/2010 | Toroko et al. | |
| 8,009,107 | B2 * | 8/2011 | Li | H01Q 5/35 343/700 MS |
| 9,716,319 | B2 * | 7/2017 | Caratelli | H01Q 5/35 |
| 9,722,326 | B2 | 8/2017 | Chistyakov et al. | |
| 9,819,094 | B2 | 11/2017 | Matitsine et al. | |
| 9,917,375 | B2 | 3/2018 | Korva et al. | |
| 10,164,346 | B2 | 12/2018 | Ming et al. | |
| 10,193,236 | B1 | 1/2019 | Lee et al. | |
| 2003/0038752 | A1 | 2/2003 | Park | |
| 2004/0160374 | A1 | 8/2004 | Johansson et al. | |
| 2005/0259019 | A1 * | 11/2005 | Miles | H01Q 1/246 343/754 |
| 2007/0008236 | A1 | 1/2007 | Tillery et al. | |
| 2008/0278394 | A1 | 11/2008 | Koh et al. | |
| 2009/0296223 | A1 | 12/2009 | Werner et al. | |
| 2011/0134008 | A1 | 6/2011 | Schadler et al. | |
| 2011/0273319 | A1 * | 11/2011 | Mossallael | H01Q 15/0086 342/1 |
| 2012/0077504 | A1 | 3/2012 | Schadler et al. | |
| 2012/0098725 | A1 | 4/2012 | Lytle et al. | |
| 2014/0176377 | A1 | 6/2014 | Merlet et al. | |
| 2015/0070230 | A1 | 3/2015 | Bradley et al. | |
| 2015/0256213 | A1 | 9/2015 | Jan et al. | |
| 2015/0303585 | A1 | 10/2015 | Chistyakov et al. | |
| 2017/0085289 | A1 | 3/2017 | Jan et al. | |
| 2018/0227775 | A1 | 8/2018 | Bisiules et al. | |

FOREIGN PATENT DOCUMENTS

| | | | |
|---|---|---|---|
| WO | WO 9213373 | A1 | 8/1992 |
| WO | WO9310572 | A1 | 5/1993 |
| WO | 2009/036305 | A1 | 3/2009 |
| WO | 2017/127378 | A1 | 7/2017 |

OTHER PUBLICATIONS

"Datasheet for SBA Smart Omni, Long, 2.3-2.4 GHz, Airspan P/Ns: Tilt 0°: SBAL- 2.3-DUAL-1", Airspan Networks Inc., Nov. 2015.
Chuck Powell, "Technical Analysis: Beamforming vs. MIMO Antennas", White Paper, Radio Frequency Systems, Mar. 2014.
Bernhard Schulz, "LTE Transmission Modes and Beamforming", White Paper, Rohde & Schwarz, Jul. 2015.
Extended European Search Report, corresponding to International Application No. 18197577.2-1205, dated Mar. 14, 2019, 9 pages.

* cited by examiner

BASE STATION ANTENNAS WITH LENSES FOR REDUCING UPWARDLY-DIRECTED RADIATION

CROSS-REFERENCE TO RELATED APPLICATIONS

The present application claims priority under 35 U.S.C. § 119 to U.S. Provisional Patent Application Ser. No. 62/565,284, filed Sep. 29, 2017, and to U.S. Provisional Patent Application Ser. No. 62/593,425, filed Dec. 1, 2017, the entire content of each of which is incorporated herein by reference as if set forth in its entirety.

FIELD

The present invention relates to cellular communications systems and, more particularly, to base station antennas for cellular communications systems.

BACKGROUND

Cellular communications systems are well known in the art. In a typical cellular communications system, a geographic area is divided into a series of regions that are referred to as "cells," and each cell is served by a base station. Typically, a cell may serve users who are within a distance of, for example, 2-20 kilometers from the base station, although smaller cells are typically used in urban areas to increase capacity. The base station may include baseband equipment, radios and antennas that are configured to provide two-way radio frequency ("RF") communications with fixed and mobile subscribers ("users") that are positioned throughout the cell. In many cases, the cell may be divided into a plurality of "sectors," and separate antennas provide coverage to each of the sectors. The antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon.

In order to increase capacity, cellular operators have, in recent years, been deploying so-called "small cell" cellular base stations. A small cell base station refers to a low-power base station that may operate in the licensed and/or unlicensed frequency spectrum that has a much smaller range than a typical "macro cell" base station. A small cell base station may be designed to serve users who are within a small geographic region (e.g., tens or hundreds of meters of the small cell base station). Small cells may be used, for example, to provide cellular coverage to high traffic areas within a macro cell, which allows the macro cell base station to offload much or all of the traffic in the vicinity of the small cell base station. Small cells may be particularly effective in Long Term Evolution ("LTE") cellular networks in efficiently using the available frequency spectrum to maximize network capacity at a reasonable cost. Small cell base stations typically employ an antenna that provides full 360 degree coverage in the azimuth plane and a suitable beamwidth in the elevation plane to cover the designed area of the small cell. In many cases, the small cell antenna will be designed to have a small downtilt in the elevation plane to reduce spill-over of the antenna beam of the small cell antenna into regions that are outside the small cell and also for reducing interference between the small cell and the overlaid macro cell.

FIG. 1A is a schematic diagram of a conventional small cell base station 10. As shown in FIG. 1A, the base station 10 includes an antenna 20 that may be mounted on a raised structure 30. In the depicted embodiment, the structure 30 is a small antenna tower, but it will be appreciated that a wide variety of mounting locations may be used including, for example, utility poles, buildings, water towers and the like. The antenna 20 may be designed to have an omnidirectional antenna pattern in the azimuth plane for at least some of the frequency bands served by the base station antenna, meaning that at least one antenna beam generated by the antenna 20 may extend through a full 360 degree circle in the azimuth plane.

As is further shown in FIG. 1A, the small cell base station 10 also includes base station equipment such as baseband units 40 and radios 42. A single baseband unit 40 and a single radio 42 are shown in FIG. 1A to simplify the drawing, but it will be appreciated that more than one baseband unit 40 and/or radio 42 may be provided. Additionally, while the radio 42 is shown as being co-located with the baseband equipment 40 at the bottom of the antenna tower 30, it will be appreciated that in other cases the radio 42 may be a remote radio head that is mounted on the antenna tower 30 adjacent the antenna 20. The baseband unit 40 may receive data from another source such as, for example, a backhaul network (not shown) and may process this data and provide a data stream to the radio 42. The radio 42 may generate RF signals that include the data encoded therein and may amplify and deliver these RF signals to the antenna 20 for transmission via a cabling connection 44. It will also be appreciated that the base station 10 of FIG. 1A will typically include various other equipment (not shown) such as, for example, a power supply, back-up batteries, a power bus, Antenna Interface Signal Group ("AISG") controllers and the like.

FIG. 1B is a composite of several views of an antenna beam 60 having an omnidirectional pattern in the azimuth plane that may be generated by the antenna 20. In particular, FIG. 1B includes a perspective three-dimensional view of the antenna beam 60 (labelled "3D pattern") as well as plots of the azimuth and elevation patterns thereof. The azimuth pattern is generated by taking a horizontal cross-section through the middle of the three dimensional antenna beam 60, and the elevation pattern is generated by taking a vertical cross-section through the middle of the three dimensional beam 60. The three-dimensional pattern in FIG. 1B illustrates the general shape of the generated antenna beam in three dimensions. As can be seen, the antenna beam 60 extends through a full 360 degrees in the azimuth plane, and the antenna beam 60 may have a nearly constant gain in all directions in the azimuth plane. In the elevation plane, the antenna beam 60 has a high gain at elevation angles close to the horizon (e.g., elevation angles between −10° and 10°), but the gain drops off dramatically both above and below the horizon. The antenna beam 60 thus is omnidirectional in the azimuth plane and directional in the elevation plane.

SUMMARY

Pursuant to embodiments of the present invention, base station antennas are provided that include a radiating element that extends forwardly from a backplane and that is configured to transmit and receive signals in the 5.15-5.25 GHz frequency band and a radio frequency lens that is mounted forwardly of the radiating element. The RF lens is configured to re-direct a portion of an RF signal emitted by the radiating element downwardly so that a first peak emission of RF energy through a combination of the radiating element and the RF lens at elevation angles that are greater than 30° from a boresight pointing direction of the radiating element is less than a second peak emission of RF energy through the combination of the radiating element and the RF lens at elevation angles that are less than −30° from the boresight pointing direction of the radiating element.

Pursuant to further embodiments of the present invention, base station antennas are provided that include a first vertically-extending linear array of radiating elements that includes at least a first radiating element and a second radiating element that are mounted in front of a first backplane and an RF lens that is mounted forwardly of the first radiating element. A first portion of the RF lens that is below a horizontal axis that is perpendicular to the first backplane and that extends through a center of the first radiating element has a greater average thickness in the direction of the horizontal axis than a second portion of the RF lens that is above the horizontal axis Pursuant to still further embodiments of the present invention, base station antennas are provided that include a plurality of linear arrays of radiating elements and a plurality of RF lens, each RF lens mounted forwardly of a corresponding one of the radiating elements. Each RF lens is asymmetrical about a horizontal axis that bisects its corresponding one of the radiating elements.

Pursuant to yet additional embodiments of the present invention, base station antennas are provided that include a radiating element and an RF lens that is mounted forwardly of the radiating element. The RF lens is configured to increase an azimuth beamwidth of an RF signal emitted by the radiating element and to also re-direct a portion of the RF signal emitted by the radiating element downwardly so that a first peak emission of RF energy through a combination of the radiating element and the RF lens at elevation angles that are greater than 30° from a boresight pointing direction of the radiating element is less than a second peak emission of RF energy through the combination of the radiating element and the RF lens at elevation angles that are less than −30° from the boresight pointing direction of the radiating element.

Pursuant to still further embodiments of the present invention, base station antennas are provided that include a backplane that extends along a vertical axis when the base station antenna is mounted for use, a radiating element mounted to extend forwardly from the backplane and an RF lens mounted forwardly of the radiating element. The RF lens is configured to focus RF energy emitted by the radiating element in the elevation plane while defocusing the RF energy emitted by the radiating element in the azimuth plane.

Pursuant to additional further embodiments of the present invention, base station antennas are provided that include a backplane that extends along a vertical axis when the base station antenna is mounted for use, a radiating element mounted to extend forwardly from the backplane and an RF lens mounted forwardly of the radiating element. An effective thickness of the RF lens has a generally concave shape along a horizontal cross-section taken through a horizontal center of the radiating element, and a generally convex shape along a vertical cross-section taken through a vertical center of the radiating element.

Pursuant to yet additional embodiments of the present invention, base station antennas are provided that include an RF lens that is mounted forwardly of a radiating element. The RF lens includes at least first and second materials that have different respective first and second dielectric constants, the second dielectric constant being less than the first dielectric constant, wherein the material having the second dielectric constant extends in a generally vertical direction or a generally horizontal direction through the RF lens.

BRIEF DESCRIPTION OF THE DRAWINGS

FIG. 19A is a horizontal cross-section of the RF lens of the antenna of FIGS. 4A-4D while

DETAILED DESCRIPTION

Figure 1A:
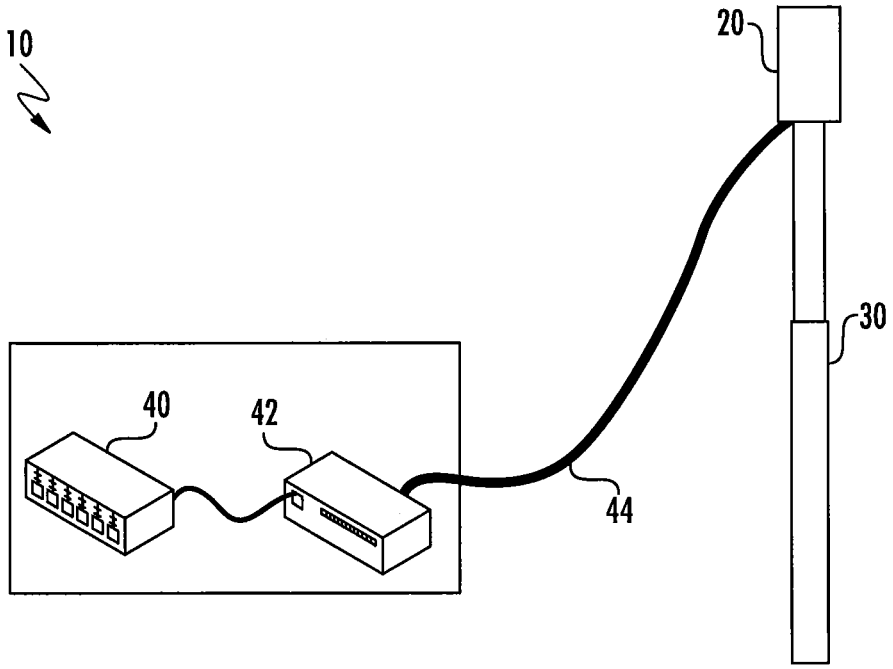
FIG. 1A is a simplified schematic diagram illustrating a conventional small cell cellular base station.
Figure 1B:
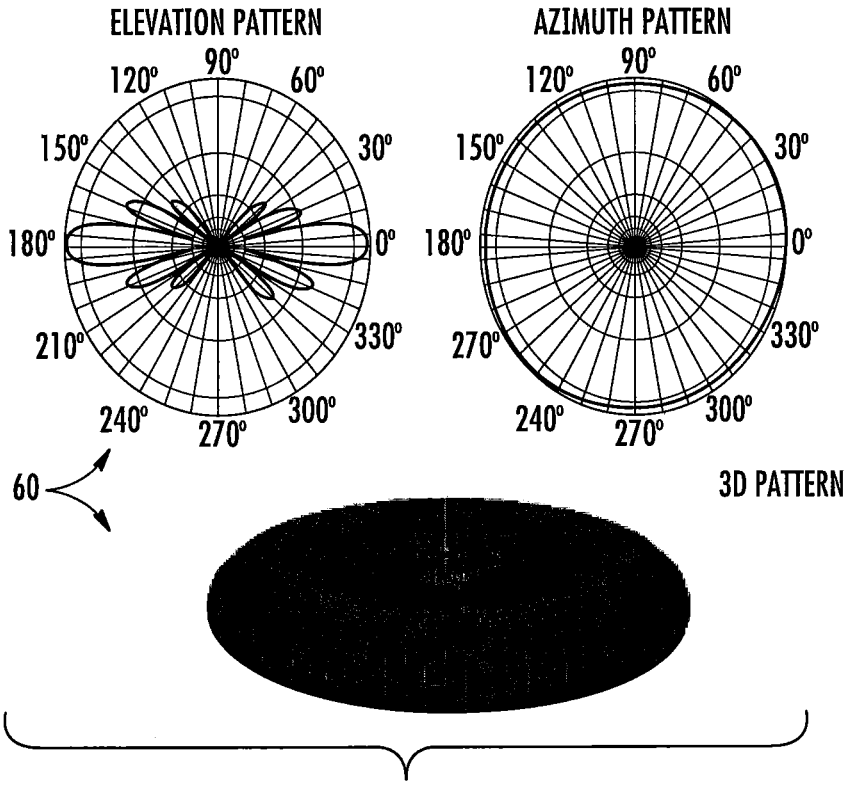
FIG. 1B provides several views of an antenna beam that may be generated by the antenna of the conventional small cell base station of FIG. 1A.

As capacity requirements continue to increase, cellular operators are deploying base stations that operate in LTE Licensed Assisted Access (LTE-LAA) mode. In one version of LTE-LAA, the Unlicensed National Information Infrastructure or "UNII" frequency band is used. The UNII frequency band refers to a portion of the radio frequency spectrum used by IEEE 802.11a devices for "WiFi" communications. Originally, the UNII frequency band was limited to indoor applications in the United States, but the United States Federal Communication Commission ("FCC") changed the rules in 2014 to allow outdoor usage. The UNII frequency band includes four sub-bands that are referred to as UNII-1 through UNII-4. The UNII-1 frequency band is in the 5.15-5.25 GHz frequency band. Under LTE-LAA, the UNII-1 unlicensed frequency band may be used in combination with licensed spectrum to deliver higher data rates for subscribers. The LTE-LAA functionality is typically implemented with indoor and outdoor small cell base stations. By distributing traffic between the licensed and unlicensed bands, LTE-LAA frees up capacity in the licensed spectrum, benefiting users on those frequency bands, as well as providing high data rate communications to other users using unlicensed spectrum. LTE-LAA may be implemented by adding a 5 GHz radio to a conventional base station and by adding one or more "5 GHz" linear arrays of 5.15-5.25 GHz radiating elements (referred to herein as "5 GHz radiating elements") to the conventional base station antenna. Each 5 GHz linear array may include at least one 5 GHz radiating element.

While LTE-LAA can enhance performance, guidelines promulgated by the FCC place restrictions on wireless communications in the UNII-1 (5.15-5.25 GHz) frequency band to reduce or prevent interference with satellite communications that operate in similar frequency ranges. In particular, for all elevation angles greater than 30° above the horizon, the effective isotropic radiated power ("EIRP") must be less than or equal to 125 mW. For a system designed to supply a signal having a maximum power of 0.5 Watts (for two ports) to an antenna array for transmission, this corresponds to the following two specific restrictions:

1. Gain of the array <6 dBi; and
2. All energy radiated at angles of 30 degrees or more above the horizon must be suppressed by the gain of the array +6 dB.

These requirements may be difficult to meet, since the first requirement generally requires a low directivity antenna pattern, while the second requirement requires a higher directivity pattern in order to reduce the width of the main lobe of the antenna beam in the elevation plane and to reduce the magnitude of the upper sidelobes with respect to the main lobe. In particular, both the upper sidelobes of the antenna pattern as well as the upper edge of the main lobe, if the main lobe is wide, can potentially violate the second requirement. Both the magnitude of the upper sidelobes as well as the width of the main lobe may be reduced by increasing the directivity of the beam, which can be achieved by adding additional 5 GHz radiating elements to the linear array(s). However, if the directivity of the beam is increased sufficiently to comply with the second requirement, the gain may surpass 6 dBi and hence run afoul of the first requirement.

Pursuant to embodiments of the present invention, base station antennas are provided that include radiating elements having RF lenses that are designed to steer RF energy that is directed at higher elevation angles downward enough so that the upper sidelobes and the upper side of the main lobe(s) of the antenna beam(s) generated by the antenna meet requirements such as the above-described UNII-1 requirements. In addition to allowing the antenna to meet requirements such as the UNII-1 requirements, the RF lenses may also advantageously provide a downtilt to the antenna beam and/or improve the overall shape of the main beam. While meeting the UNII-1 requirements is one example application for the lensed base station antennas according to embodiments of the present invention, it will be appreciated that these antennas may be used in other applications. For example, in the 2.3 GHz WCS frequency band there are similar limits regarding the amount of radiation directed away from the horizon that may be addressed using the techniques disclosed herein.

In some embodiments, base station antennas are provided that include a radiating element that extends forwardly from a backplane and that is configured to transmit and receive signals in the 5.15-5.25 GHz frequency band and a radio frequency lens that is mounted forwardly of the radiating element. The RF lens is configured to re-direct a portion of an RF signal emitted by the radiating element downwardly so that a first peak emission of RF energy through a combination of the radiating element and the RF lens at elevation angles that are greater than 30° from a boresight pointing direction of the radiating element is less than a second peak emission of RF energy through the combination of the radiating element and the RF lens at elevation angles that are less than −30° from the boresight pointing direction of the radiating element.

In other embodiments, base station antennas are provided that include a first vertically-extending linear array of radiating elements that includes at least a first radiating element and a second radiating element that are mounted in front of a first backplane and an RF lens that is mounted forwardly of the first radiating element. A first portion of the RF lens that is below a horizontal axis that is perpendicular to the first backplane and that extends through a center of the first radiating element has a greater average thickness in the direction of the horizontal axis than a second portion of the RF lens that is above the horizontal axis. In situations where the goal is to suppress the radiation emitted at high elevation angles below the horizon, the asymmetry of the lens with respect to the horizontal axis may be reversed (e.g., the lens may be rotated 180 degrees). In this situation, a first portion of the RF lens that is below a horizontal axis that is perpendicular to the first backplane and that extends through a center of the first radiating element will have a smaller average thickness in the direction of the horizontal axis than a second portion of the RF lens that is above the horizontal axis.

In still other embodiments, base station antennas are provided that include a plurality of linear arrays of radiating elements and a plurality of RF lens, each RF lens mounted forwardly of a corresponding one of the radiating elements. Each RF lens is asymmetrical about a horizontal axis that bisects its corresponding one of the radiating elements In some embodiments, the RF lenses may be designed to only substantially impact the elevation pattern of the radiating elements. In other embodiments, the RF lenses may also be designed to, for example, both focus and/or redirect the RF radiation in the elevation plane while also defocusing the RF radiation in the azimuth pattern. In some cases, the defocusing of the RF radiation in the azimuth pattern may be performed simply to restore the azimuth pattern that existed before the RF lenses were added, as an RF lenses with a rectangular cross-section in the azimuth plane will tend to narrow main lobes of the azimuth pattern. In other cases, the defocusing of the RF radiation in the azimuth pattern may be performed to fill in nulls in the azimuth pattern that existed even when RF lenses were not used. In either case, the defocusing of the RF radiation may be accomplished by, for example, forming the RF lenses to have a generally concave shape along a horizontal cross-section taken through a horizontal center of a radiating element associated with the RF lens and a generally convex shape along a vertical cross-section taken through a vertical center of the associated radiating element. The generally concave horizontal cross-section and the generally convex vertical cross-section may be achieved by physically shaping the RF lens to have the desired concave shape along horizontal cross-sections of the RF lens and the desired convex shape along vertical cross-sections of the RF lens and/or by forming the RF lens using materials having different dielectric constants.

In some embodiments, the RF lenses may be used in conjunction with linear arrays of radiating elements that are configured to transmit and receive signals in about the 5 GHz range (e.g., in the 5.15-5.25 GHz frequency band). In some embodiments, these 5 GHz linear arrays may be mounted on a tubular reflector that has a rectangular cross-section in the azimuth plane. In such embodiments, a 5 GHz linear array may be mounted on each face of the four-sided tubular reflector assembly. The tubular reflector assembly may also include additional linear arrays of radiating elements such as, for example, "low-band" linear arrays that operate, for example, in some or all of the 696-960 MHz frequency band and/or may further include "mid-band" linear arrays that operate, for example, in some or all of the 1.7-2.7 GHz frequency band. The low-band linear arrays, the mid-band linear arrays and/or the 5 GHz linear arrays may be configured to support MIMO operation. In some embodiments, the low-band linear arrays and/or the mid-band linear arrays operate in licensed spectrum and may be additionally or alternatively configured to be beam-forming antennas.

In some embodiments, the base station antenna may include four linear arrays of 5 GHz radiating elements that operate in the unlicensed spectrum. The four linear arrays may be mounted on the four main faces of a rectangular tubular reflector assembly. In some embodiments, all four 5 GHz linear arrays may be commonly fed from a single port of a radio and may form a single antenna beam (or may be commonly fed by two ports of the radio if the 5 GHz radiating elements are cross-polarized radiating elements so as to form two antenna beams at orthogonal polarizations). In other embodiments, the first and third 5 GHz linear arrays may be mounted on opposed main faces of the rectangular tubular reflector assembly and may be commonly fed to generate a first antenna beam that has a peanut-shaped cross-section in the azimuth plane. The second and fourth 5 GHz linear arrays may be mounted on the other two opposed main faces of the rectangular tubular reflector assembly and may be commonly fed to generate a second antenna beam that also has a peanut shaped cross-section in the azimuth plane. The second antenna pattern may have substantially the same shape as the first antenna pattern and may be rotated approximately ninety degrees with respect to the first antenna pattern in the azimuth plane. Together, the peanut-shaped first and second antenna beams may form a suitable omnidirectional antenna beam in the azimuth plane. If the 5 GHz linear arrays comprise dual-polarized radiating elements such as, for example, slant −45°/+45° cross-dipole radiating elements, a total of four antenna beams may be generated in the 5 GHz band to support 4× MIMO operation. In some embodiments, the radiating elements may be designed to transmit signals at both 5 GHz and at 3.5 GHz. When such 3.5/5 GHz radiating elements are used, the base station antenna may operate in two separate frequency bands, namely a 3.5 GHz band and a 5 GHz band. In such embodiments, a diplexer may be included in the antenna that separates received 3.5 GHz signals from received 5 GHz signals and that combines 3.5 GHz and 5 GHz signals that are received from a radio for transmission, thus allowing the two different frequency bands to be served by separate ports on the base station antenna.

In some embodiments, the base station antenna may also include four linear arrays of radiating elements that operate in the licensed spectrum that are mounted on the four main faces of the rectangular tubular reflector assembly. The first and third licensed spectrum linear arrays may be mounted on opposed main faces of the rectangular tubular reflector assembly and may be commonly fed to generate a first antenna beam that has a peanut shaped cross-section in the azimuth plane. The second and fourth licensed spectrum linear arrays may be mounted on the other two opposed main faces of the rectangular tubular reflector assembly and may be commonly fed to generate a second antenna beam that also has a peanut-shaped cross-section in the azimuth plane. The second antenna pattern may have substantially the same shape as the first antenna pattern and may be rotated approximately ninety degrees with respect to the first antenna pattern in the azimuth plane. Together, the peanut-shaped first and second antenna beams may form a suitable omnidirectional antenna beam in the azimuth plane. The above-described licensed spectrum linear arrays may have comprise dual-polarized radiating elements such as, for example, slant −45°/+45° cross-dipole radiating elements so that a total of four antenna beams are generated in the low-band and/or the mid-band so that the antenna may support 4×MIMO operation in the low-band and/or the mid-band.

The base station antenna according to embodiments of the present invention may exhibit a number of advantages compared to conventional base station antenna. As described above, these base station antenna may meet the very challenging FCC requirements associated with communications in the UNII-1 frequency band as well as various other frequency bands (e.g., the WCS frequency band) that set limits on upwardly- or downwardly-directed RF radiation by including RF lenses that re-direct a portion of the upwardly-emitted radiation downwardly, or vice versa. The added RF lenses may be lightweight and inexpensive, and hence may have little impact on the cost and weight of the antenna. The RF lenses also may be quite small, and may, in many cases, fit within the existing envelope of a base station antenna radome since larger, lower frequency radiating elements may require a larger diameter radome than the combination of each 5 GHz radiating element and its associated RF lens. Additionally, the RF lenses may also be designed to further improve the shape of the 5 GHz (or other frequency band) antenna beam by, for example, adding some degree of downtilt and/or spreading out the antenna beam in the azimuth plane.

Example embodiments of the invention will now be discussed in more detail with reference to the attached drawings.

Figure 2:
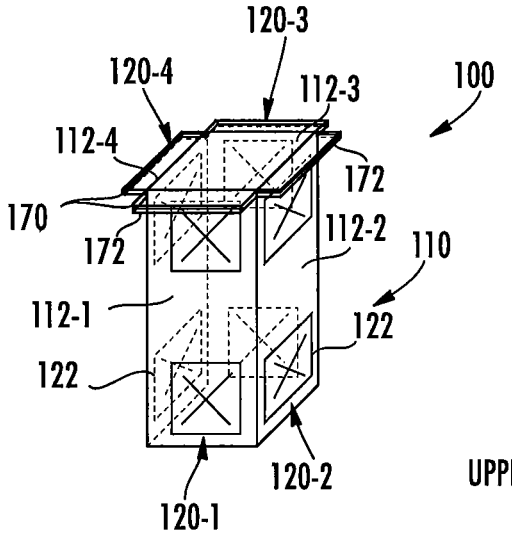
FIG. 2 is a schematic perspective diagram illustrating a base station antenna that is configured to transmit and receive signals in the UNII-1 frequency band.

FIG. 2 is a schematic perspective diagram illustrating a base station antenna 100 according to embodiments of the present invention. As shown in FIG. 2, the base station antenna 100 includes a rectangular tubular reflector assembly 110 that has four vertically-oriented linear arrays 120-1 through 120-4 of radiating elements 122 mounted thereon Each face of the reflector assembly 110 may comprise a backplane 112-1 through 112-4. Each backplane 112 may comprise a unitary structure or may comprise a plurality of structures that are attached together. Each backplane 112 may comprise, for example, a reflector that serves as a ground plane for the radiating elements 122 of the linear arrays 120 mounted thereon. It should be noted that herein, when multiple like or similar elements are provided, they may be labelled in the drawings using a two-part reference numeral (e.g., backplane 112-2). Such elements may be referred to herein individually by their full reference numeral (e.g., backplane 112-2) and may be referred to collectively by the first part of their reference numeral (e.g., the backplanes 112).

Each linear array 120 is mounted on a respective one of the backplanes 112, and may be oriented vertically with respect to the horizon when the base station antenna 100 is mounted for use. In the depicted embodiment, each linear array 120 includes a total of two radiating elements 122. It will be appreciated, however, that other numbers of radiating elements 122 may be included in the linear arrays 120, including linear arrays 120 that only have a single radiating element 122. Any appropriate radiating element 122 may be used including, for example, dipole, cross-dipole and/or patch radiating elements. Each of the radiating elements 122 may be identical. The radiating elements 122 may extend forwardly from the respective backplanes 112. In the depicted embodiment, each radiating element 122 includes a pair of dipole radiators that are arranged orthogonally to each other at angles −45° and the +45° with respect to the longitudinal (vertical) axis of the antenna 100. The radiating elements may be 5 GHz radiating elements in some embodiments. In other embodiments, the radiating elements 122 may be 3.5/5 GHz radiating elements 122 that are designed to transmit and receive signals in both the 3.5 GHz frequency band and in the 5 GHz frequency band. The base station antenna 100 may further include a radome (not shown) that covers and protects the radiating elements 122 and other components of the base station antenna 100. It will be appreciated that the base station antenna 100 may also include a number of conventional components that are not depicted in FIG. 2.

As discussed above, the FCC requirements for the UNII-1 frequency band require suppression of RF radiation emitted at elevation angles greater than 30°. In order to suppress such radiation, the base station antenna 100 includes an RF shield 170 and/or RF absorbing material 172 that are positioned above the radiating elements 122.

In particular, as shown in FIG. 2, the base station antenna 100 includes an RF shield 170 that extends forwardly from the backplanes 112 above each of the linear arrays 120. While in the depicted embodiment four separate RF shields 170 are depicted, it will be appreciated that in other embodiments the four RF shields 170 could be replaced with a single RF shield with a circular outer diameter that extends from the four backplanes 112. The RF shield 170 may be formed of a reflective material such as metal and may redirect downwardly RF energy from the radiating elements 122 that is incident thereon. The RF shield 170 may extend forwardly from each backplane 112 farther than the radiating elements 122 mounted thereon. The RF shield 170 may reflect upwardly-emitted radiation downwardly, thereby reducing the magnitude of the upper sidelobes in the elevation plane of the antenna pattern to assist in attempting to meet the FCC requirements for the UNII-1 frequency band.

As is further shown in FIG. 2, RF-absorbing material 172 may also be used to reduce the amount of upwardly directed radiation. The RF-absorbing material 172 may be placed on top of the RF shield 170, underneath the RF shield 170 and/or in any other appropriate location to capture and absorb upwardly-directed RF radiation from the radiating elements 122. In an example embodiment, the RF-absorbing material 172 may be lined on the lower surface of the RF shield 170. The RF-absorbing material 172 may comprise, for example, a carbon-loaded polymer foam, rubber or any other material that absorbs and/or attenuates RF radiation. The RF-absorbing material 172 may be used in lieu of or in addition to the RF shield 170. The RF-absorbing material 172 may have different shapes and/or thickness than is shown in FIG. 2, and may also be placed in additional or different locations. In both embodiments that include and do not include the RF shield 170, the RF-absorbing material could, for example, be attached to the top end of the reflector 110, fixed in place by a support, or attached to the top end cap of the antenna 100.

The use of RF shields 170 and/or RF-absorbing material 172, however, may not be sufficient to consistently meet the FCC requirements. A third technique to reduce RF radiation emitted at elevation angles greater than 30° is to put a fixed phase taper on the two radiating elements 122 in each linear array 120 to electronically downtilt the elevation pattern. Accordingly, the antenna 100 may have a feed network (not shown) that is designed to apply such a phase taper to provide an electronic downtilt of the antenna beam. While downtilt may help move the upper edge of the main lobe to be less than 30° above the horizon, the phase taper that is used to adjust the main beam downwardly may elevate the upper sidelobes making it more likely that the upper sidelobes are not compliant with the FCC requirements. Thus, in many situations, an electronic downtilt may not be particularly helpful in meeting the FCC requirements.

Figure 3:
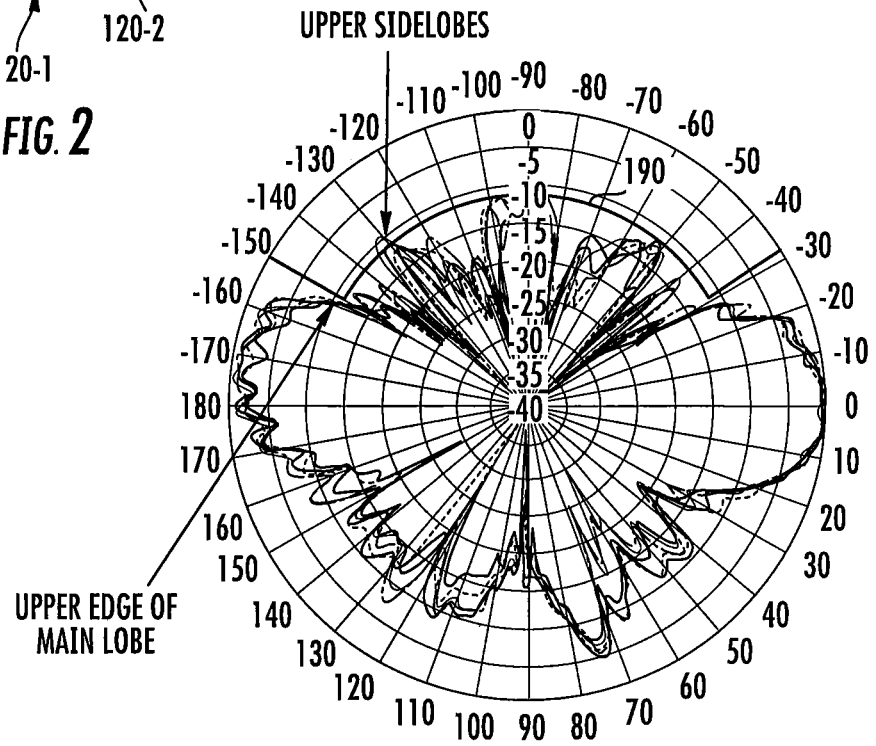
FIG. 3 is a graph showing elevation patterns for various of the lensed radiating elements of the base station antenna of FIG. 2.

FIG. 3 is a graph showing elevation patterns for various of the radiating elements of the base station antenna 100 of FIG. 2 (with the RF shields 170 and RF absorbing material 172 included, but without any electronic downtilt to the elevation pattern). In FIG. 3, curve 190 plots the FCC requirements for the UNII-1 frequency band with respect to the illustrated elevation patterns. As can be seen in FIG. 3, the upper edges of several of the main lobes are right at the edge of the envelope (curve 190) defined by the FCC requirements. As also be seen, some of the upper sidelobes extend beyond the envelope of curve 190.

Thus, FIG. 3 illustrates that even when combining several different techniques for reducing RF radiation emitted at elevation angles greater than 30° it still may be difficult to consistently meet the FCC requirements for the UNII-1 frequency band.

Figure 4A:
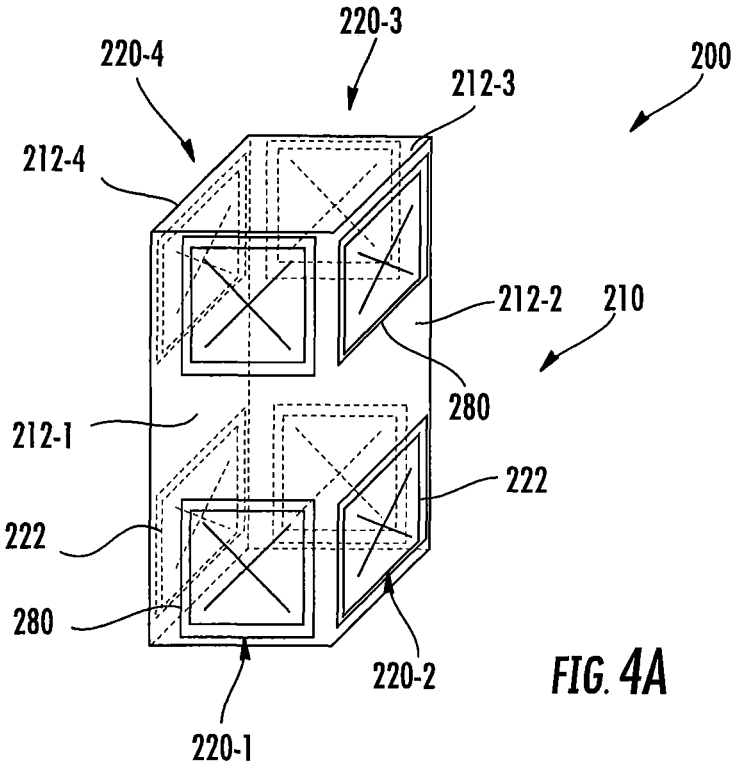
FIG. 4A is a highly simplified schematic perspective diagram illustrating the reflector assembly and radiating elements of a lensed base station according to embodiments of the present invention.
Figure 4B:
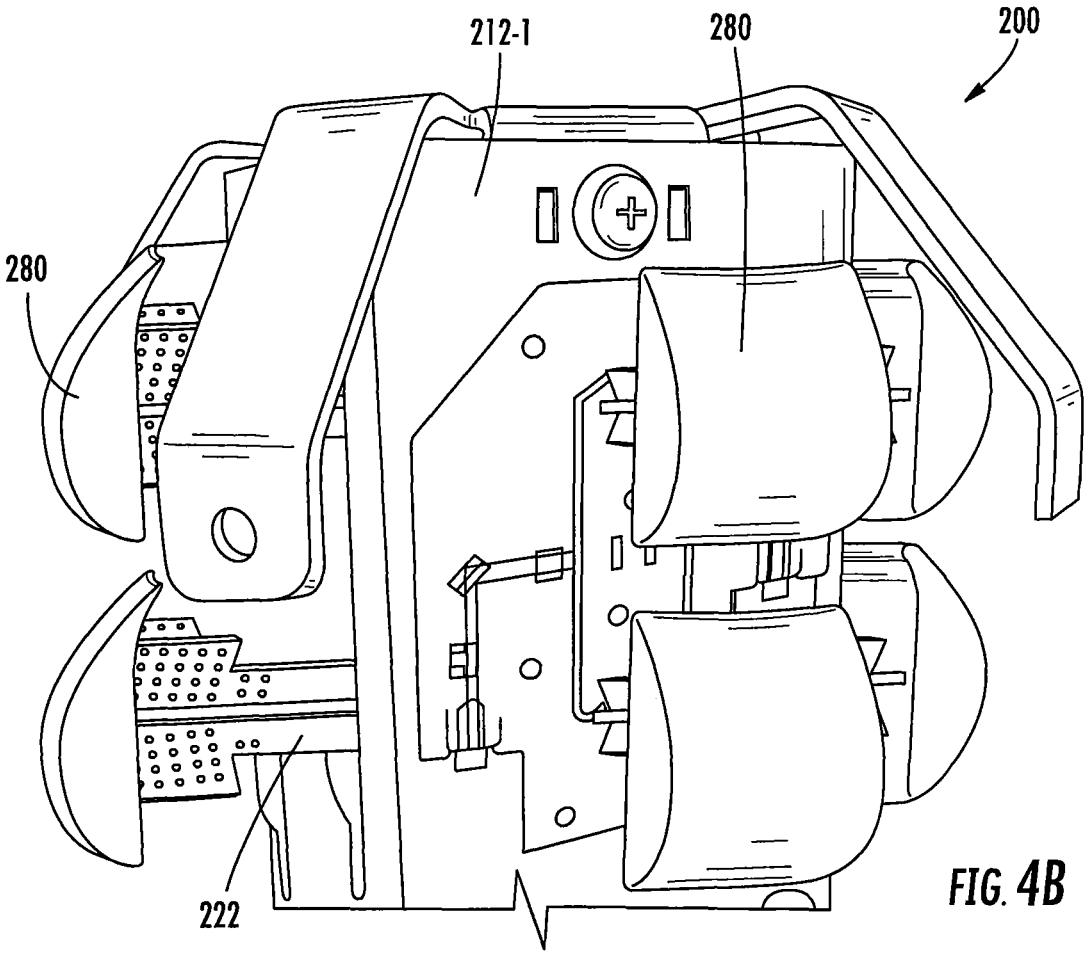
FIG. 4B is a perspective view of a physical implementation of the base station antenna of FIG. 4A with the radome removed.
Figure 4C:
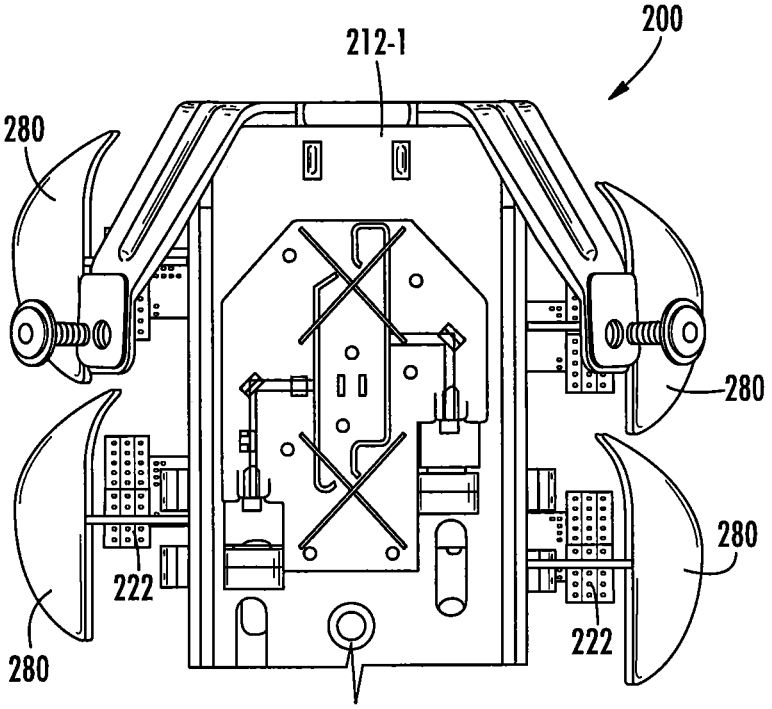
FIG. 4C is a schematic side view of the base station antenna of FIG. 4A with the radome removed.
Figure 4D:
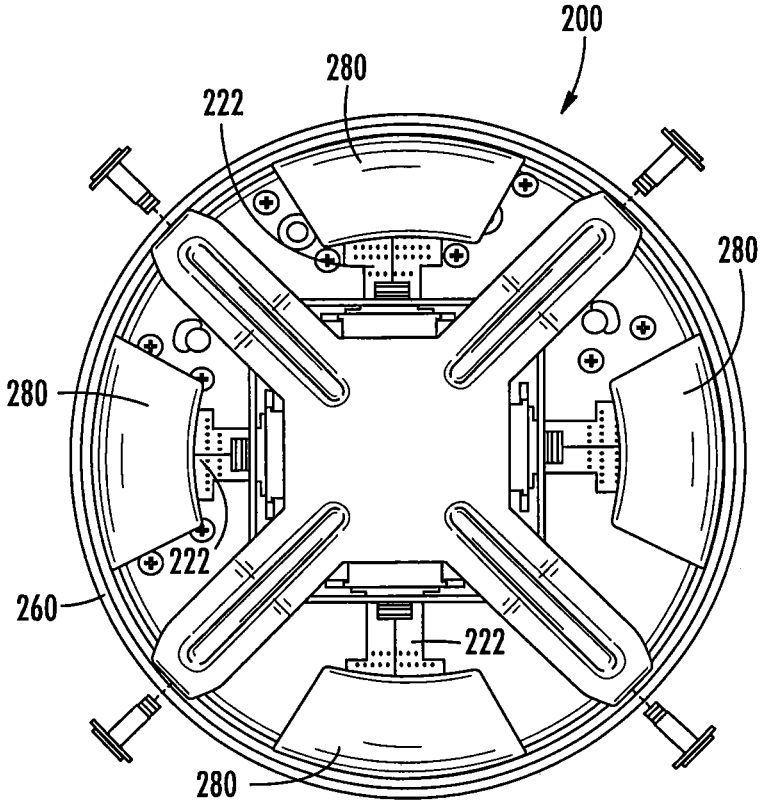
FIG. 4D is a schematic top view of the base station antenna of FIG. 4A.

FIGS. 4A-4D are various views of a lensed base station antenna 200 according to embodiments of the present invention. In particular, FIG. 4A is a schematic perspective view of the reflector assembly and radiating elements of the base station antenna 200, FIG. 4B is a perspective view of a physical implementation of the antenna 200 with the radome removed, FIG. 4C is a schematic side view of the antenna 200 with the radome removed, and FIG. 4D is a schematic top view of the antenna 200.

As shown in FIGS. 4A-4D, the base station antenna 200 includes a rectangular tubular reflector assembly 210 that has four vertically-oriented linear arrays 220-1 through 220-4 of radiating elements 222 mounted thereon. Each face of the reflector assembly 210 may comprise a backplane 212-1 through 212-4 that may act as both a reflector and a ground plane for the radiating elements 222 of the linear arrays 220 mounted thereon. The reflector assembly 210, backplanes 212, linear arrays 220 and radiating elements 222 may be identical to the reflector assembly 110, backplanes 112, linear arrays 120 and radiating elements 122 of the base station antenna 100 of FIG. 2, and hence further description thereof will be omitted. A radome 260 (see FIG. 40) may surround and protect the radiating elements and other components of the antenna 200. While not shown in FIGS. 4A-4D to simplify the drawings, the base station antenna 200 may include an RF shield and/or RF-absorbing material, which may be identical in structure and mounting locations to the RF shield 170 and the RF absorbing material 172 of the base station antenna 100 of FIG. 2.

Each radiating element 222 may comprise a pair of dipole radiators that are arranged orthogonally to each other at angles −45° and the +45° with respect to the longitudinal (vertical) axis of the antenna 200. FIGS. 14A-14D are various views of one of the 3.5/5 GHz cross-dipole radiating element 222. As shown in FIGS. 14A-14D, each radiating element 222 may be formed using a pair of printed circuit boards 226-1, 226-2. One of the printed circuit boards 226 includes a forward central slit while the other printed circuit board 226 includes a rearward central slit that allows the two printed circuit boards 226 to be mated together so as to form an "X" shape when viewed from the front as shown best in FIG. 14D.

The radiating element 222 includes a pair of 3.5 GHz dipole arms 228-1, 228-2 that are directly driven through respective baluns 223. The 3.5/5 GHz cross-dipole radiating element 222 further includes 5 GHz dipole arms 224-1, 224-2 that are located forwardly of the 3.5 GHz dipole arms 228-1, 228-2. When a 3.5 GHz signal is input to a balun 223, it is fed directly to the 3.5 GHz dipoles 228-1, 228-2. When a 5 GHz signal is input to the balun, the energy electromagnetically couples to the 5 GHz parasitic dipole arms 224-1, 224-2 which then resonate at 5 GHz. While dual-band radiating elements 222 are illustrated in FIGS. 14A-14D, it will be appreciated that single-band radiating elements 222 may be used in other embodiments.

Referring again to FIGS. 4A-4D, the base station antenna 200 further includes an RF lens 280 for each radiating element 222. The RF lenses 280 are depicted schematically as squares in FIG. 4A, but in FIGS. 4B-4D an example design for the RF lenses is shown. Each RF lens 280 may be designed to steer or "re-direct" a portion of the RF energy incident thereupon downwardly. The RF lenses 280 may be formed of any suitable dielectric material that steers RF energy. The RF lenses 280 may be fabricated from materials that are both lightweight and inexpensive in some embodiments. In some embodiments, the RF lenses 280 may be formed of polyethylene, polypropylene, expanded polypropylene, acrylonitrile butadiene styrene (ABS), polystyrene or expanded polystyrene, each of which are commonly available thermoplastic materials. In other embodiments, the RF lenses may be formed in whole or part using so-called artificial dielectric materials such as the lens materials disclosed in U.S. patent application Ser. No. 15/464,442, filed Mar. 21, 2017, the entire content of which is incorporated herein by reference. In some cases, the dielectric material used to form the RF lenses 280 may be a lightweight material having a density in the range of, for example, 0.005 to 0.1 g/cm$^3$, and may have a dielectric constant that is between 1 to 3. Operation of the RF lenses 280 will be discussed in greater detail below with reference to FIG. 7.

Figure 5A:
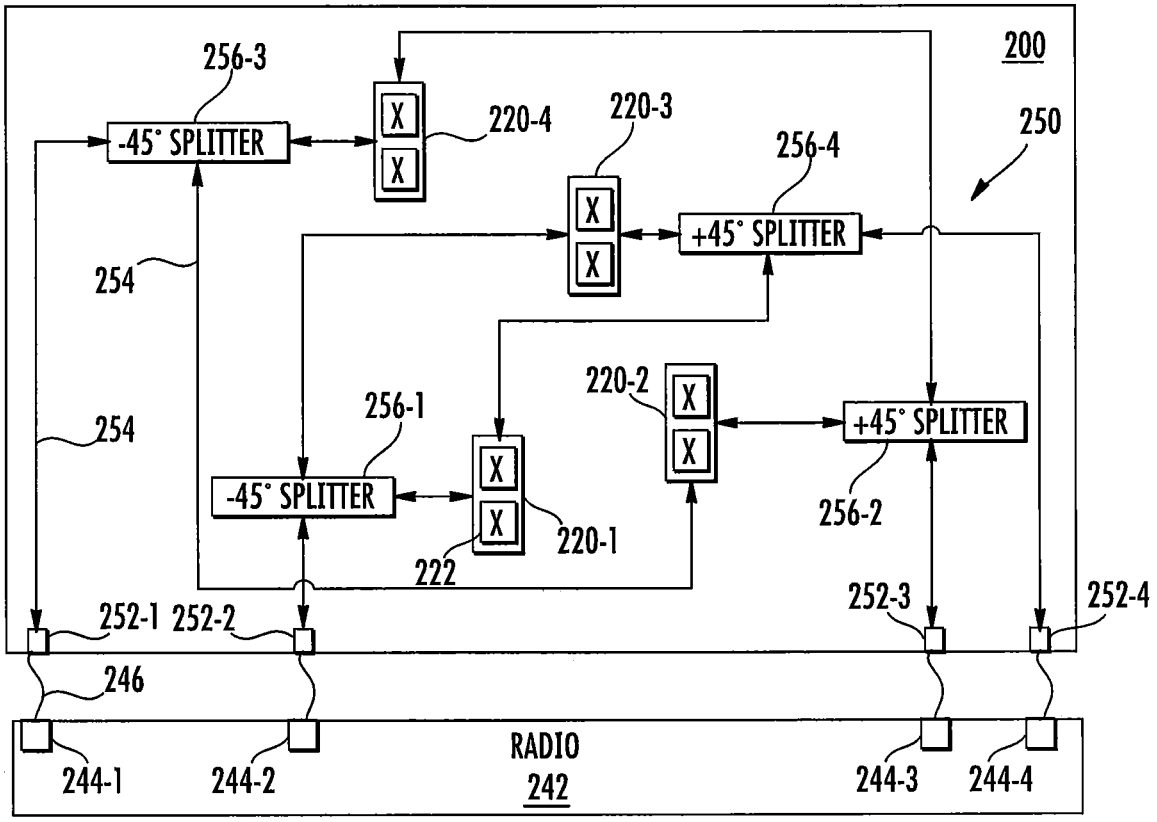
FIGS. 5A and 5B are block diagrams illustrating example feed networks that may be included in the base station antenna of FIGS. 4A-4D.

FIG. 5A is a block diagram illustrating a feed network 250 that may be included in some embodiments of the base station antenna 200 of FIGS. 4A-4D. In FIG. 5A (as well as in the alternative embodiment of FIG. 5B), the diplexer and the 3.5 GHz radio have been omitted to simplify the drawing, and hence only the 5 GHz feed ports are shown.

As shown in FIG. 5A, in an example embodiment, the antenna 200 may be fed by a 5 GHz radio 242 that has four ports 244-1 through 244-4. Duplexing of the transmit and receive channels is performed internal to the radio 242, so each port 244 on the radio 242 passes both transmitted and received RF signals. In such an embodiment, the antenna 200 may include four ports 252-1 through 252-4. Each of the ports 252 may comprise a standard connector port such as a 7/16 DIN connector port, a mini-DIN connector port or a 4.3/10 connector port. Each port 244 on the radio 242 may be connected to a respective one of the ports 252 on the antenna 200 via a coaxial cable 246.

As discussed above, each radiating element 222 includes a pair of 5 GHz dipole radiators that are arranged orthogonally to each other at angles of −45° and +45° with respect to the longitudinal (vertical) axis of the antenna 200. The provision of four ports 244 on radio 242 allows the radio 242 to feed signals to two different subsets of the linear arrays 220 of base station antenna 200 at two different (orthogonal) polarizations. Since the base station antenna 200 has slant −45°/+45° cross-dipole radiating elements 222, the two polarizations will be referred to as the −45° and the +45° polarizations.

As shown in FIG. 5A, the second port 244-2 of radio 242 is coupled to the −45° polarization radiators of the radiating elements 222 of linear arrays 220-1, 220-3 via a cable 254 and a first 1×2 power splitter/combiner 256-1. The first output of the splitter/combiner 256-1 is connected to linear array 220-1 and the second output of the splitter/combiner 256-1 is connected to linear array 220-3. Similarly, the third port 244-3 of radio 242 is coupled to the +45° polarization radiators of the radiating elements 222 of linear arrays 220-1, 220-3 via a cable 254 and a second 1×2 power splitter/combiner 256-2. The first output of the splitter/combiner 256-2 is connected to linear array 220-1 and the second output of the splitter/combiner 256-1 is connected to linear array 220-3. The first port 244-1 of radio 242 is coupled to the −45° polarization radiators of the radiating elements 222 of linear arrays 220-2, 220-4 via a cable 254 and a third 1×2 power splitter/combiner 256-3. The first output of the splitter/combiner 256-3 is connected to linear array 220-2 and the second output of the splitter/combiner 256-3 is connected to linear array 220-4. Similarly, the fourth port 244-4 of radio 242 is coupled to the +45° polarization radiators of the radiating elements 222 of linear arrays 220-2, 220-4 via a cable 254 and a fourth 1×2 power splitter/combiner 256-4. The first output of the splitter/combiner 256-4 is connected to linear array 220-2 and the second output of the splitter/combiner 256-4 is connected to linear array 220-4.

In some embodiments, each 1×2 splitter/combiner 256 may split RF signals received from the respective ports 244 into two equal power sub-components that are provided to the respective radiating elements 222 of the two linear arrays 220 that are fed by each splitter/combiner 256. In other embodiments, the power split may be unequal. In some embodiments, the sub-components of each split signal may be fed to the respective linear arrays 220 with the same phase delay, while in other embodiments a phase taper may be applied to the signals fed to the two radiating elements 222 of each linear array 220 in order to affect electronic downtilts to the elevation patterns of the antenna beams. This electronic downtilt of the elevation pattern may further help in forming antenna beams that meet the FCC requirements for the UNII-1 frequency band.

When the base station antenna 200 is fed in the manner discussed above with reference to FIG. 5A, the antenna 200 may generate two distinct antenna patterns at each of two polarizations for a total of four antenna beams. In particular, a first −45° polarization antenna beam is generated by linear arrays 220-1 and 220-3 and a second −45° polarization antenna beam is generated by linear arrays 220-2 and 220-4. Likewise, a first +45° polarization antenna beam is generated by linear arrays 220-1 and 220-3 and a second +45° polarization antenna beam is generated by linear arrays 220-2 and 220-4. Based on the pointing direction of the linear arrays 220, each antenna beam may have a generally peanut-shaped cross-section in the azimuth plane, since each antenna beam is generated by linear arrays 220 that point in opposite directions in the azimuth plane. The antenna beams at each polarization are offset by 90 degrees with respect to each other in the azimuth plane. Together, the two antenna beams (at each polarization) may provide an omnidirectional antenna pattern in the azimuth plane.

Figure 5B:
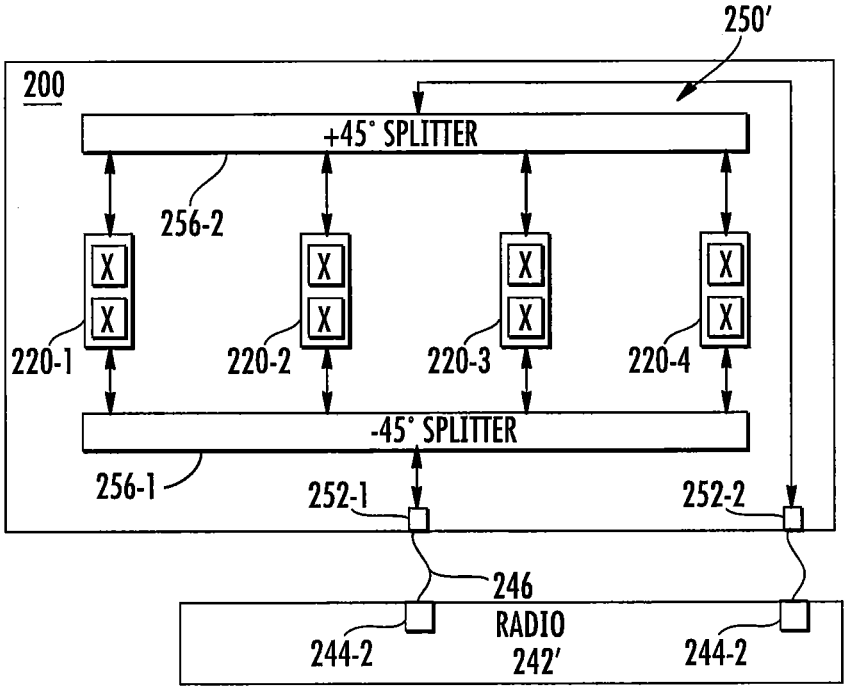

In other embodiments, the linear arrays 220 may be fed by a two-port radio 242'. In particular, as shown in FIG. 5B, in another embodiment, the antenna 200 may be fed by a radio 242' that has two ports 244-1 and 244-2. Duplexing of the transmit and receive channels is performed internal to the radio 242', so each port 244 on the radio 242' passes both transmitted and received RF signals. In such an embodiment, the antenna 200 may include two ports 252-1 and 252-2. Each port 244 on the radio 242' may be connected to a respective one of the ports 252 on the antenna 200 via a respective coaxial cable 246.

As shown in FIG. 5B, each port 244 of radio 242' is coupled to all four linear arrays 220-1 through 220-4. One port 244-1 delivers signals having a −45° polarization to the linear arrays 220 while the other port 244-2 delivers signals having a +45° polarization to the linear arrays 220. In each case, the four linear arrays 220 may together transmit a quasi-omnidirectional antenna pattern in the azimuth plane. The feed network includes a pair of 4×1 splitter/combiners 256-1 and 256-2 that split the signals four ways to feed the four linear arrays 220. In some embodiments, the sub-components of each split signal may be fed to the respective linear arrays 220 with the same phase delay, while in other embodiments a phase taper may be applied to the signals fed to the two radiating elements of each array in order to affect electronic downtilts to the elevation patterns of the antenna beams. This electronic downtilt of the elevation pattern may further help in forming antenna beams that meet the FCC requirements for the UNII-1 frequency band.

Figure 6:
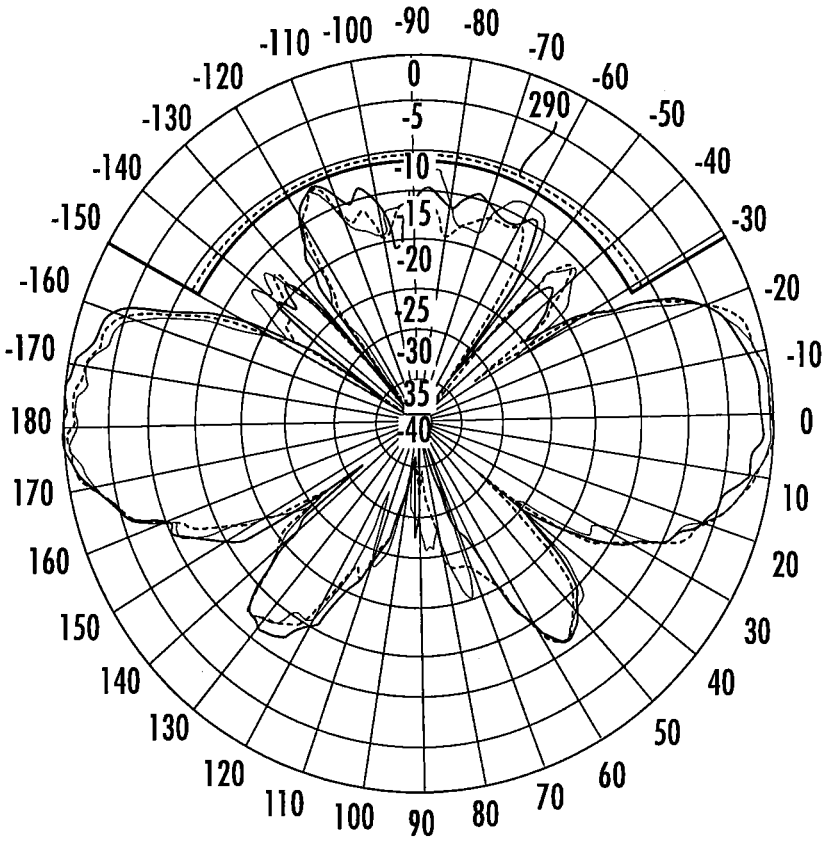
FIG. 6 is a graph showing elevation patterns for various of the lensed radiating elements the base station antenna of FIGS. 4A-4D.

FIG. 6 is a graph showing elevation patterns for various of the lensed radiating elements of the base station antenna 200. In FIG. 6, curve 290 plots the FCC requirements for the UNII-1 frequency band with respect to the illustrated elevation patterns. As can be seen in FIG. 6, when the RF lenses 280 are added, the elevation pattern fits within the envelope of curve 290. Moreover, the main lobes exhibit an increased downtilt in the elevation plane, moving the upper edges of the main lobes away from the envelope 290 and also providing an improved shape for the main lobe.

As can be seen by comparing FIGS. 3 and 6, each RF lens 280 included in the base station antenna 200 acts to re-direct a portion of an RF signal emitted by its corresponding radiating element 222 (i.e., the radiating element 222 that the RF lens is mounted in front of) downwardly. As a result, a first peak emission of RF energy through a combination of the radiating element and the RF lens at elevation angles that are greater than 30° from a boresight pointing direction of the radiating element 222 is less than a second peak emission of RF energy through the combination of the radiating element and the RF lens at elevation angles that are less than −30° from the boresight pointing direction of the radiating element 222. This can be seen in FIG. 6 since the lower sidelobe in the bottom right quadrant of the figure has a peak that is about 2 dB higher than the peak of the highest upper sidelobe.

Figure 7:
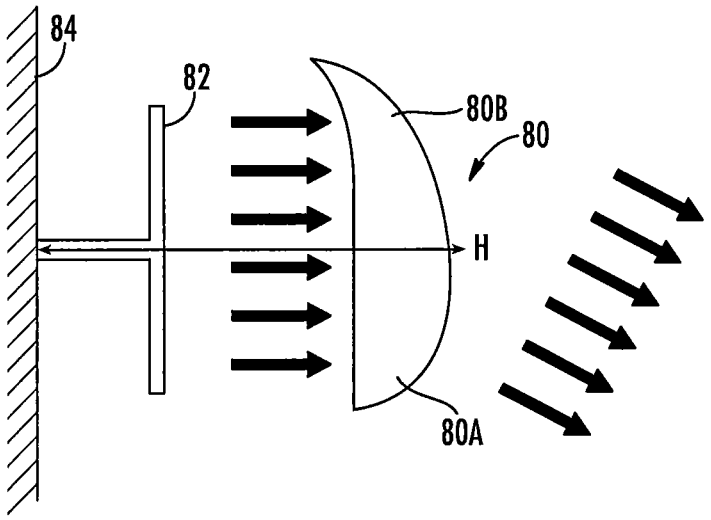
FIG. 7 is a schematic diagram explaining the basic operation of the RF lenses included in the base station antenna of FIGS. 4A-4D.

FIG. 7 is a schematic diagram explaining the basic operation of the RF lenses 280 included in the base station antenna of FIGS. 4A-4D. As shown in FIG. 7, a lens 80 may be placed generally in front of a radiating element 82. According to Snell's Law, radio waves are bent at the interface of two materials having different dielectric constant. By placing the RF lens 80 formed of dielectric material in front of the radiating element 82, an air/lens dielectric boundary is formed that bends the radio waves emitted by the radiating element 82. In some embodiments, the RF lens 80 may have a generally convex shape. This generally convex shape acts to focus the RF energy that is transmitted by the radiating element 82 therethrough downwardly, thereby reducing the amount of RF energy emitted in the direction of higher elevation angles such as elevation angles greater than 30°.

In some embodiments, the RF lens 80 may have an asymmetric shape along a horizontal axis H that extends through (and bisects) the radiating element 82 and the RF lens 80 when a base station antenna that includes the RF lens 80 is mounted for use. As a result, a first portion 80A of the RF lens 80 is below the horizontal axis H and a second portion 80B of the RF lens 80 is above the horizontal axis H. As shown in FIG. 7, the upper portion 80B of the RF lens 80 may have a decreased thickness in a lateral direction (along horizontal axis H) as compared to a lower portion 80A of the RF lens 80. As a result of this decreased thickness, the RF radiation passing through the RF lens 80 may be directed downwardly. In other words, the RF radiation is steered downwardly in the direction of the thicker portion of the RF lens 80. The lower portion 80A of the RF lens 80 may thus have a greater amount of dielectric material than the upper portion 80B. In some embodiments, the asymmetry may result in an RF lens that has a generally wedge-shaped as opposed to having a generally convex shape. In some embodiments, RF lenses having two or more different dielectric materials may be used. In such embodiments, the RF lens may have more symmetric shapes, if desired, since the difference in dielectric materials may be used to steer a portion of the RF energy downwardly.

Thus, as shown in FIG. 7, base station antennas may be provided that include a radiating element 82 that is mounted in front of a backplane 84 and an RF lens 80 that is mounted forwardly of the radiating element 82. A first portion 80A of the RF lens 80 that is below the horizontal axis H (which is perpendicular to the backplane 84 and which extends through a center of the radiating element 82) has a greater average thickness in the direction of the horizontal axis than a second portion 80B of the RF lens 80 that is above the horizontal axis H.

When the concept shown in FIG. 7 is expanded so that it is practiced with all of the radiating elements of a base station antenna, as is the case with the base station antenna 200 of FIGS. 4A-4D, a base station antenna is provided that includes a plurality of linear arrays 220 of radiating elements 222 and a plurality of RF lens 280, where each RF lens 280 is mounted forwardly of a corresponding one of the radiating elements 222 (the "corresponding" radiating element 222 for each RF lens 280 is the radiating element 222 that each RF lens 280 is mounted in front of). Each RF lens 280 is asymmetrical about a horizontal axis H that bisects the radiating element 222 corresponding to the RF lens 280.

In still other embodiments, the RF lenses may be symmetrical or near symmetrical. Such symmetrical RF lenses may tend to focus the RF energy to point more toward the horizon. In other words, these symmetrical RF lenses may direct both downwardly and upwardly emitted RF radiation more toward the horizon, thereby tending to narrow the antenna beam in the elevation plane. Such an approach may help with respect to the second FCC requirement for the UNII-1 frequency band, but may be counterproductive with respect to the first requirement, at least in some cases.

It will be appreciated that a wide variety of RF lens shapes may be used. Examples of suitable RF lens shapes are discussed below with reference to FIGS. 13A-13F.

Figure 8A:
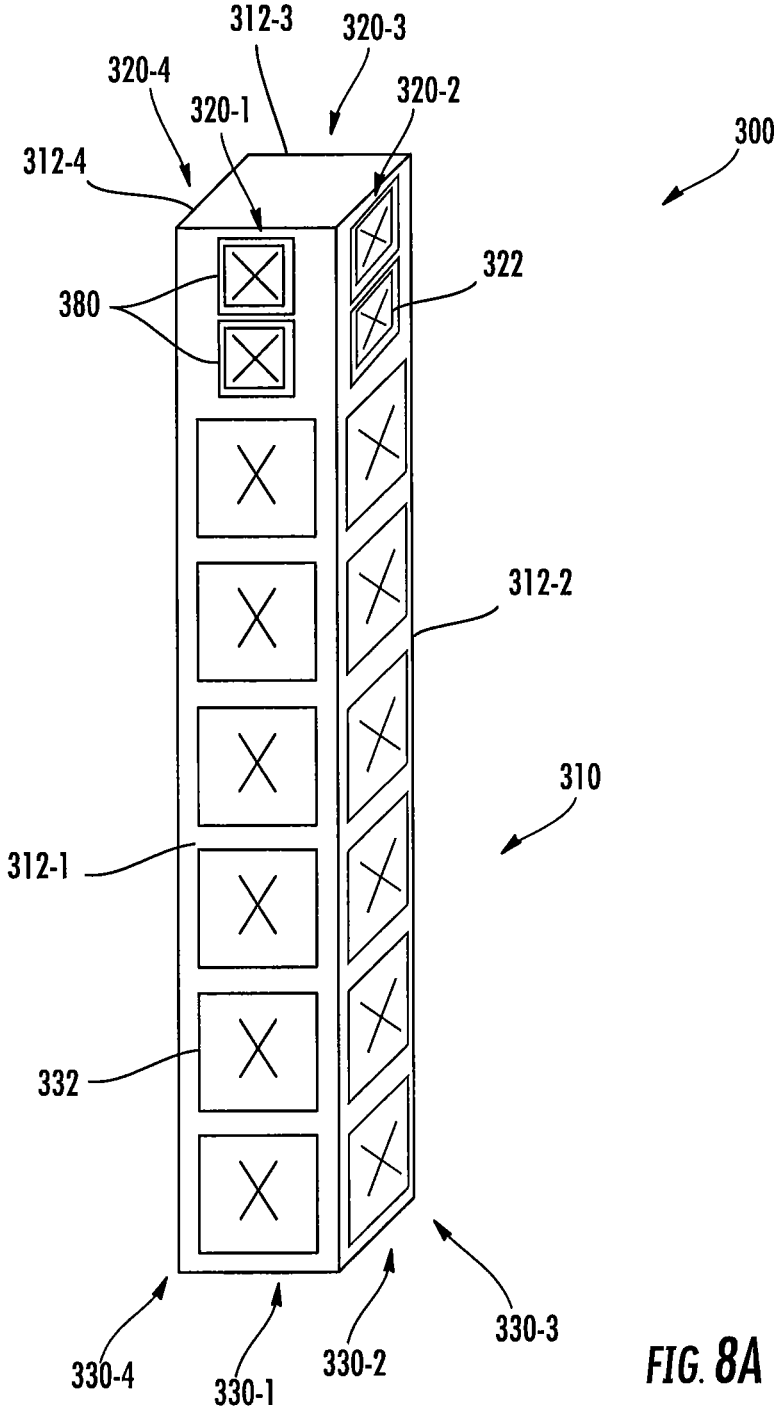
FIG. 8A is a highly simplified schematic perspective diagram illustrating the reflector assembly and radiating elements of a multi-band lensed base station according to embodiments of the present invention.
Figure 8B:
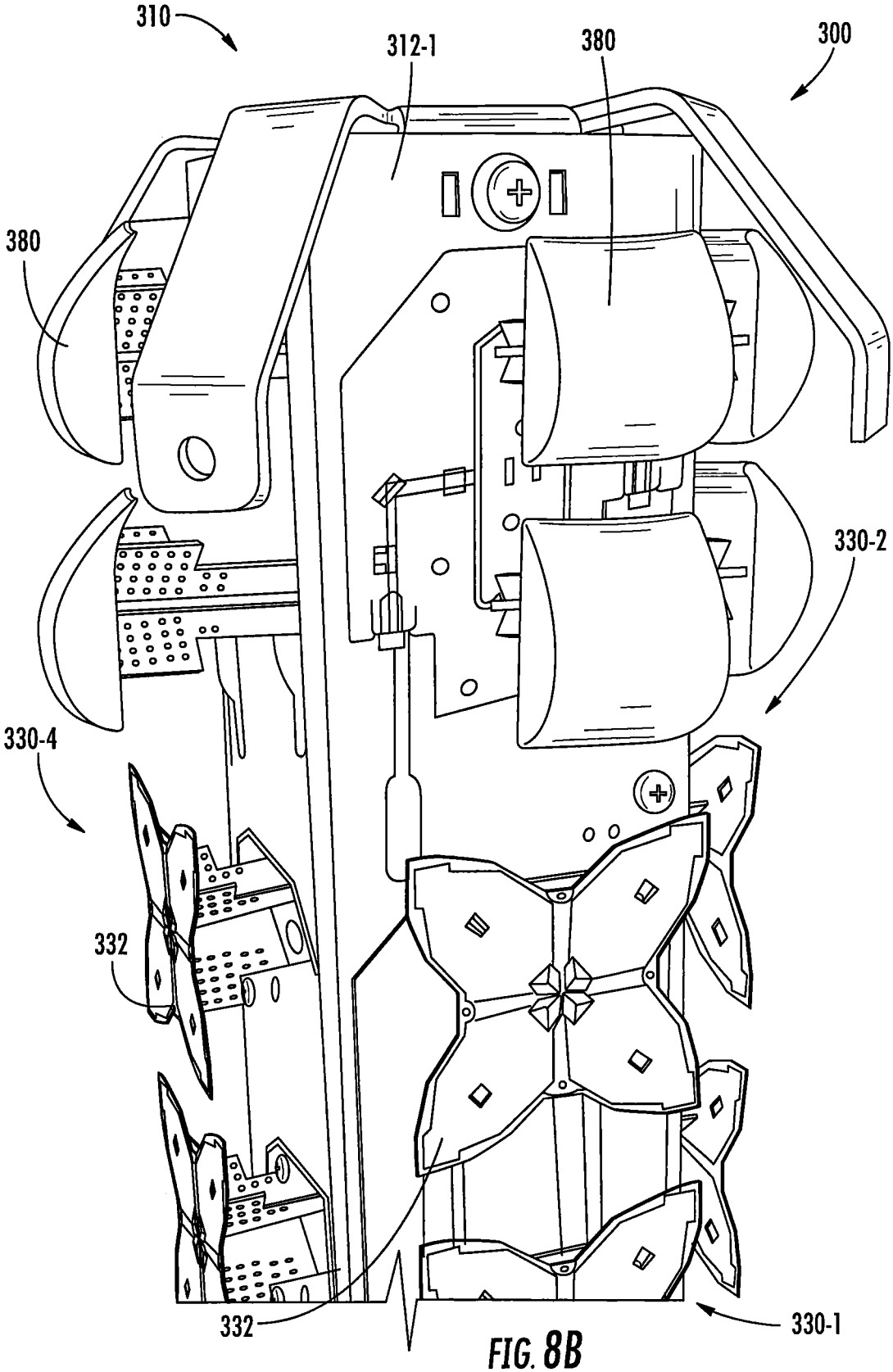
FIG. 8B is a partial perspective view of a physical implementation of the base station antenna of FIG. 8A.

As noted above, with LTE-LAA, unlicensed frequency bands may be used to enhance the performance of a cellular network. LTE-LAA is typically used in small cell base stations to provide additional capacity. When LTE-LAA is used, for cost considerations, the radiating elements for the licensed and unlicensed frequency bands are typically included in a single base station antenna. FIGS. 8A-8B illustrate a lensed small cell base station antenna 300 according to further embodiments of the present invention that includes linear arrays operating in both licensed and unlicensed frequency bands. In particular, FIG. 8A is a schematic perspective view of the reflector assembly and radiating elements of the base station antenna 300, and FIG. 8B is a partial perspective view of a physical implementation of the antenna 300.

As shown in FIGS. 8A-8B, the small cell base station antenna 300 includes a rectangular tubular reflector assembly 310. The base station antenna 300 includes four linear arrays 320-1 through 320-4 (not all of which are visible in the figures) of two radiating elements 322 each mounted thereon, and an RF lens 380 may be positioned forwardly of each radiating element 322. The linear arrays 320, radiating elements 322 and RF lenses 380 may be identical to the linear arrays 220, radiating elements 222 and RF lenses 280 described above. Accordingly, further description of the structure and operation thereof will be omitted. Likewise, the feed network 250 of FIG. 5A or the feed network 250' of FIG. 5B may be used to feed the linear arrays 320, and therefore further description of the feed network for linear arrays 320 will be omitted here. While not shown in FIGS. 8A-8B to simplify the drawings, the base station antenna 300 may include an RF shield and/or RF absorbing material, which may be identical in structure and mounting locations to the RF shield 170 and the RF absorbing material 172 of the base station antenna 100 of FIG. 2. The radiating elements 322 may be either 3.5/5 GHz radiating elements or may be 5 GHz radiating elements.

As can further be seen in FIGS. 8A-8B, the base station antenna 300 also includes a total of four so-called "mid-band" linear arrays 330-1 through 330-4 (not all of which are visible in the figures) of radiating elements 332 that are mounted on the respective backplanes 312-1 through 312-4. Each mid-band linear array may be designed, for example, to operate in all or part of the 1.7-2.7 GHz frequency band.

Each mid-band linear array 330 may be oriented vertically with respect to the horizon when the base station antenna 300 is mounted for use. In the depicted embodiment, each mid-band linear array 330 includes a total of six radiating elements 332. It will be appreciated, however, that other numbers of radiating elements 332 may be included in the mid-band linear arrays 330. Each radiating element 332 may comprise, for example, a dipole radiator. In some embodiments, each radiating element may be a cross-dipole radiating element that includes a pair of radiators. The base station antenna 300 may further include a radome (not shown) that covers and protects the radiating elements 322, 332 and other components of the base station antenna 300.

The base station antenna 300 may also include a number of conventional components that are not depicted in FIGS. 8A-8B. For example, a plurality of circuit elements and other structures may be mounted within the reflector assembly 310. These circuit elements and other structures may include, for example, phase shifters for one or more of the linear arrays, remote electronic tilt (RET) actuators for mechanically adjusting the phase shifters, one or more controllers, cabling connections, RF transmission lines and the like. Mounting brackets (not shown) may also be provided for mounting the base station antenna 300 to another structure such as an antenna tower or utility pole.

Figure 9:
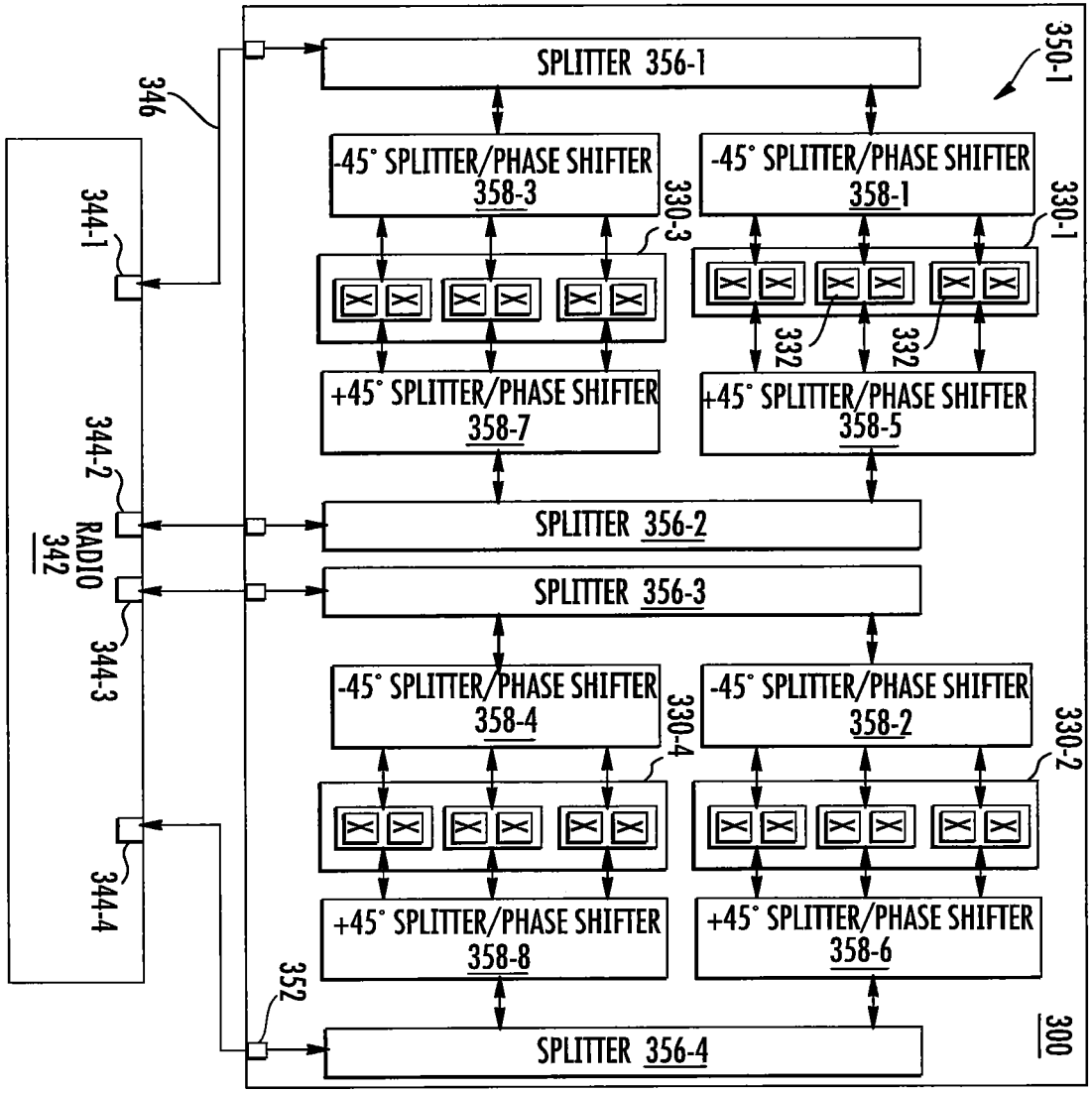
FIG. 9 is a block diagram illustrating the feed networks for the mid-band linear arrays that are included in the base station antenna of FIGS. 8A-8B.

FIG. 9 illustrates an embodiment of a feed network 350 that may be used to pass RF signals between a base station radio 342 and the radiating elements 332 of the mid-band linear arrays 330. As shown in FIG. 9, the radio 342 is a four port device having ports 344-1 through 344-4. Duplexing of the transmit and receive channels is performed internal to the radio 342, so each port 344 on the radio 342 passes both transmitted and received RF signals. The provision of four ports 344 on radio 342 allows the radio 342 to feed signals to two different subsets of the linear arrays 330 of base station antenna 300 at two different (orthogonal) polarizations. Four connectors 352 may be provided on base station antenna 300 and cables 346 (e.g., coaxial cables) may connect each port 344 on the radio 342 to a respective one of these RF connectors 352. It should be noted that FIG. 9 does not illustrate the 5 GHz radio, the 5 GHz linear arrays or the feed network for the 5 GHz linear arrays (or any 3.5 GHz elements). As noted above, the feed networks of FIG. 5A or FIG. 5B may be used to connect the 5 GHz linear arrays 320 to a 5 GHz radio.

As shown in FIG. 9 the first port 344-1 of radio 342 is coupled to the radiators of the radiating elements 332 of linear arrays 330-1, 330-3 that are arranged to transmit/receive signals having a −45° polarization via a first 1×2 power splitter/combiner 356-1, and the second port 344-2 of radio 342 is coupled to the radiators of the radiating elements 332 of linear arrays 330-1, 330-3 that are arranged to transmit/receive signals having a +45° polarization via a second 1×2 power splitter/combiner 356-2. Likewise, the third port 344-3 of radio 342 is coupled to the radiators of the radiating elements 332 of linear arrays 330-2, 330-4 that are arranged to transmit/receive signals having a −45° polarization via a third power splitter/combiner 356-3, and the fourth port 344-4 of radio 342 is coupled to the radiators of the radiating elements 332 of linear arrays 330-2, 330-4 that are arranged to transmit/receive signals having a +45° polarization via a fourth splitter/combiner 356-4. Each splitter/combiner 356 splits RF signals received from a radio port 344 into sub-components that are fed to respective phase shifters 358 that are connected to certain of the linear arrays 330. Each phase shifter 358 may split the RF signals input thereto three ways and may apply a phase taper across the three sub-components of the RF signal to, for example, apply an electronic downtilt to the antenna beam that is formed when the sub-components of the RF signal are transmitted (or received) through the respective linear arrays 330. The radio 342 may thus transmit a mid-band RF signal through four different paths through base station antenna 300 to generate four different mid-band antenna beams (namely two different beams that are each replicated at two polarizations).

Figure 10A:
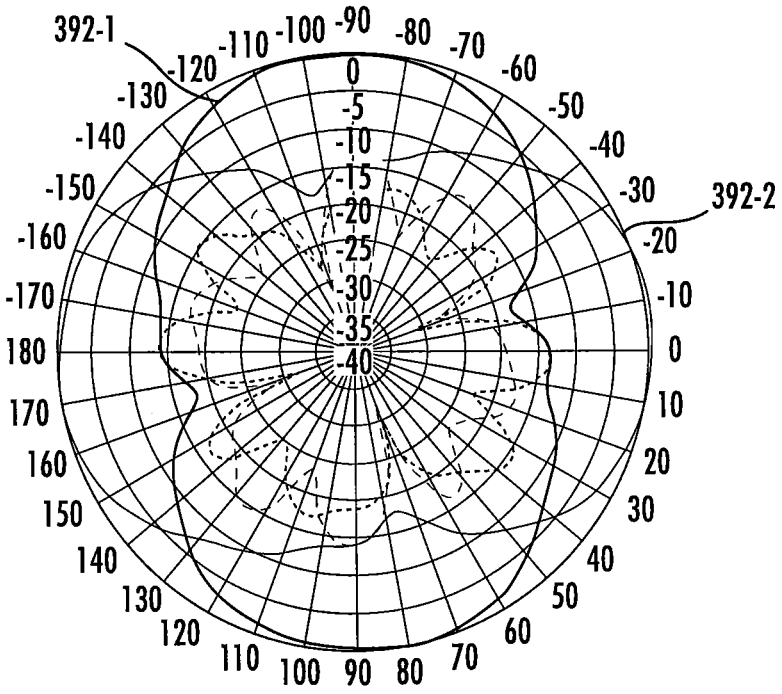
FIGS. 10A and 10B are graphs illustrating azimuth and elevation cross-sections of the mid-band antenna beams of the small cell base station antenna of FIGS. 8A-8B.
Figure 10B:
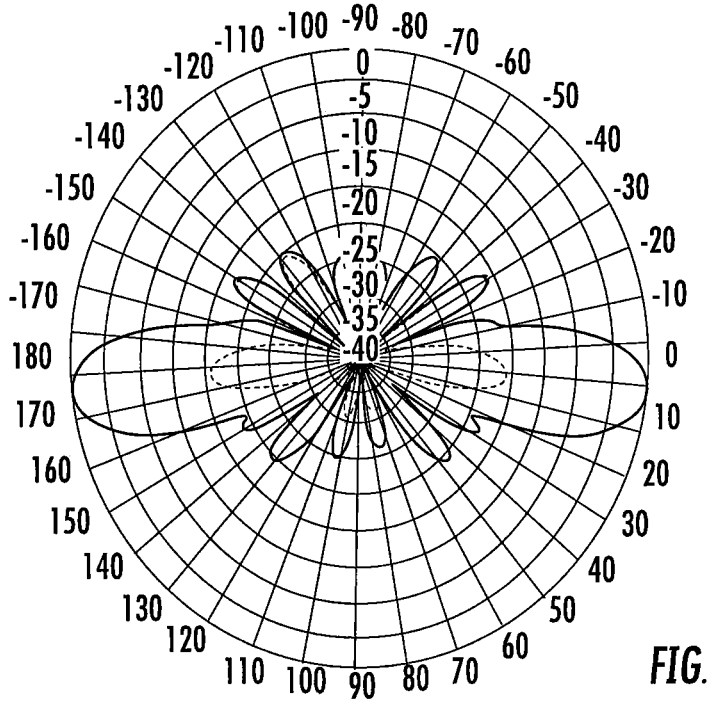

FIG. 10A illustrates the azimuth pattern for the −45° polarization antenna beams generated by linear arrays 330. As shown in FIG. 10A, the first and third linear arrays 330-1, 330-3 may together form a first antenna beam 392-1 that has a peanut-shaped cross-section in the azimuth plane. Likewise, the second and fourth linear arrays 330-1, 330-3 may together form a second antenna beam 392-2 that has a peanut-shaped cross-section in the azimuth plane. Together, the antenna beams 392-1, 392-2 may provide an omnidirectional antenna pattern in the azimuth plane. The +45° polarization antenna beams may be identical to what is shown in FIG. 10A. FIG. 10B illustrates the simulated antenna pattern in the elevation azimuth plane for each antenna beam.

It should be noted that when 3.5/5 GHz radiating elements are used to implement the high-band radiating elements 322, the 3.5 GHz signals may be fed to the 3.5 GHz radiating elements 322 using a feed network that is identical to feed network 350-1 of FIG. 9, so that the 3.5 GHz radiating elements will generate a pair of antenna beams having peanut-shaped cross-section in the azimuth plane that look essentially like the antenna beams 392-1, 392-2 shown in FIG. 10 (which are the mid-band patterns), although the nulls in the pattern tend to be more pronounced at the higher frequency.

The mid-band linear arrays 330 and/or the 3.5 GHz portion of the 3.5/5 GHz linear arrays may employ multi-input-multi-output ("MIMO") capabilities. MIMO refers to a technique where a signal is output through multiple ports of a radio and transmitted through multiple different antenna arrays (or sub-arrays) that are, for example, spatially separated from one another and/or at orthogonal polarizations. The amplitudes and phases of the signals transmitted through the different ports may be set so that the signals transmitted through the multiple antenna arrays will constructively combine at the user device. The use of MIMO transmission techniques may help overcome the negative effects of multipath fading, reflections of the transmitted signal off of buildings and the like to provide enhanced transmission quality and capacity. Small cell base stations are often implemented in high-density urban environments. These environments may have numerous buildings which make these environments natural applications for using MIMO transmission techniques. The linear arrays 330 of small cell base station antenna 300 may generate four different antenna beams and hence may be used to implement diversity to provide 4×MIMO capabilities (i.e., the linear arrays 330 transmit a MIMO signal along four different paths). As discussed above with reference to FIG. 5A, in some embodiments, the 5 GHz linear arrays 320 may also be configured to support 4×MIMO operations.

Figure 11:
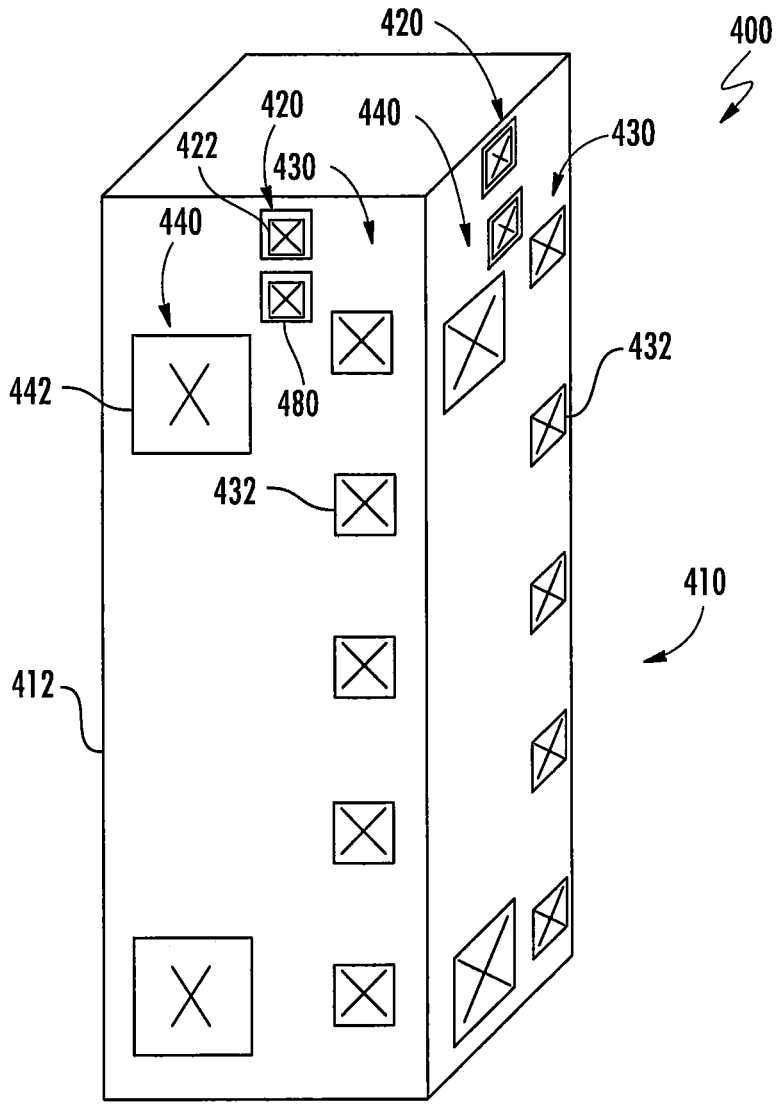
FIG. 11 is a schematic perspective view of another multi-band small cell base station antenna according to embodiments of the present invention.

FIG. 11 is a schematic perspective view of another multi-band small cell base station antenna 400 according to further embodiments of the present invention. The base station antenna 400 may be identical to the base station 300 described above, except that the base station antenna 400 includes a third linear array of so-called "low-band" radiating elements on each of the four backplanes 412. As such, elements of base station antenna 400 that have been described above will not be addressed further (in FIG. 11 the reference numerals have all been increased by one hundred for consistency from the corresponding reference numerals in FIGS. 8A-8B). Each low-band linear array may be designed, for example, to operate in all or part of the 696-960 MHz frequency band.

As shown in FIG. 11, in addition to the linear arrays 420 and 430, which may be identical in structure and operation to linear arrays 320 and 330 of base station antenna 300, base station antenna 400 further includes four low-band (e.g., 800 MHz) linear arrays 440 of radiating elements 442, only two of which are visible in the schematic view of FIG. 11. In the depicted embodiment, each low-band linear array 440 includes a total of two radiating elements 442. The low-band linear arrays 440 may be fed in the exact same manner as the mid-band linear arrays 430 in order to generate four antenna beams having peanut-shaped cross-sections in the azimuth plane. The low-band linear arrays 440 may be used to transmit in a 4×MIMO mode.

While not shown in the figures, in another embodiment, two of the four linear arrays 440 may be omitted (namely the linear arrays 440 on two opposed backplanes 412) so that the low-band linear arrays 440 only generate two antenna beams, namely antenna beams at each polarization that have a peanut-shaped cross-section in the azimuth plane. In such embodiments, the low-band arrays 440 may be operated to implement 2×MIMO.

Figure 12A:
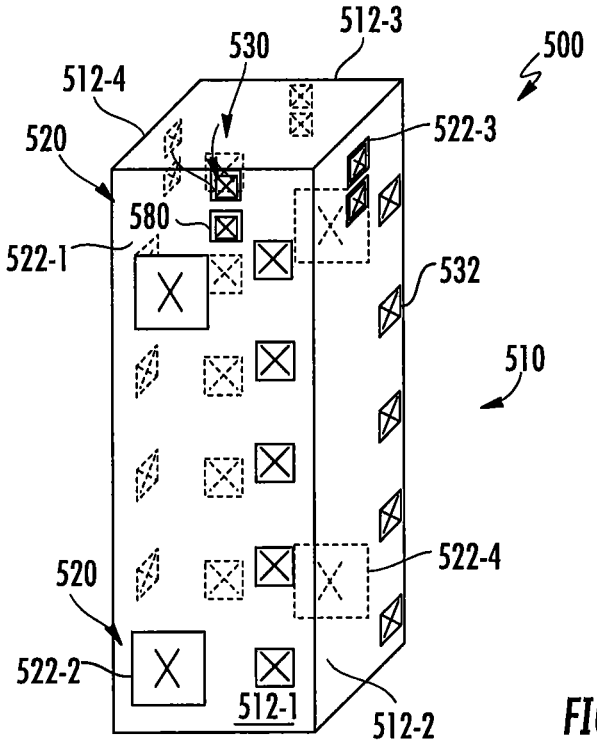
FIG. 12A is a schematic diagram illustrating a quad-band base station antenna according to still further embodiments of the present invention.
Figure 12B:
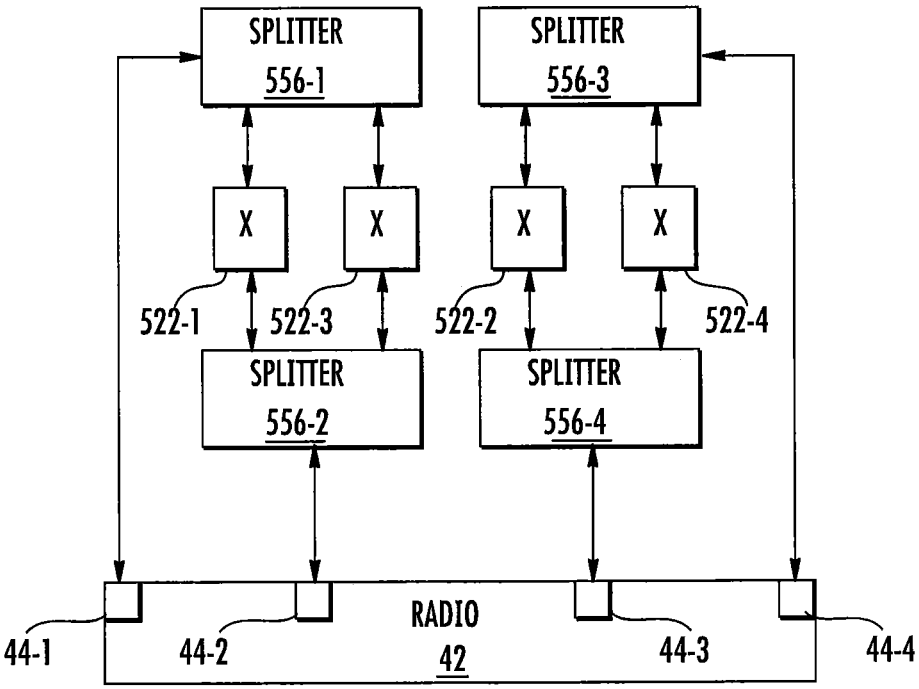
FIG. 12B is a block diagram illustrating how the low-band radiating elements of the small cell base station antenna of FIG. 12A may be connected to a four-port radio.

FIGS. 12A and 12B illustrate a small cell base station antenna according to further embodiments of the present invention. Referring first to FIG. 12A, a small cell base station antenna 500 is schematically shown that is similar to the small cell base station antenna 400 of FIG. 11, except that the antenna 500 only includes a total of four low-band radiating elements 542 instead of eight low-band radiating elements 442 included in base station antenna 400, yet can still transmit in 4×MIMO mode in the low-band.

FIG. 12B illustrates the connections between a four-port radio 42 and the low band radiating elements 542 of the small cell base station antenna 500. As shown in FIG. 12B, a first port 44-1 of the radio 42 is coupled to a first splitter 556-1. The first splitter 556-1 splits a (transmit path) RF signal received from port 44-1 into two sub-components that are fed to the +45° dipoles of low band radiating elements 522-1 and 522-3 in order to generate a first, generally peanut-shaped antenna beam having a +45° polarization. Similarly, a second port 44-2 of the radio 42 is coupled to a second splitter 556-2. The second splitter 556-2 splits a (transmit path) RF signal received from port 44-2 into two sub-components that are fed to the −45° dipoles of low band radiating elements 522-1 and 522-3 in order to generate a second, generally peanut-shaped antenna beam having a −45° polarization. A third port 44-3 of the radio 42 is coupled to a third splitter 556-3. The third splitter 556-3 splits a (transmit path) RF signal received from port 44-3 into two sub-components that are fed to the +45° dipoles of low band radiating elements 522-2 and 522-4 in order to generate a third, generally peanut-shaped antenna beam having a +45° polarization. Similarly, a fourth port 44-4 of the radio 42 is coupled to a fourth splitter 556-4. The fourth splitter 556-4 splits a (transmit path) RF signal received from port 44-4 into two sub-components that are fed to the −45° dipoles of low band radiating elements 522-2 and 522-4 in order to generate a fourth, generally peanut-shaped antenna beam having a −45° polarization. In this fashion, a total of four transmit antenna beams may be formed to support 4×MIMO transmissions or other four-port schemes.

Figure 13A:
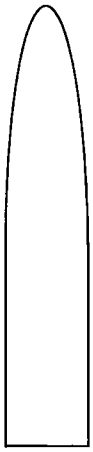
FIGS. 13A-13F are schematic diagrams illustrating different example lens designs for the base station antennas according to embodiments of the present invention.
Figure 13B:
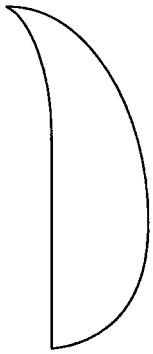
Figure 13C:
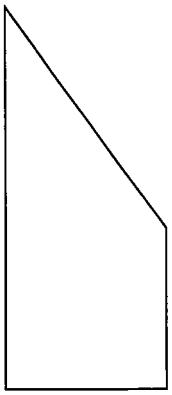
Figure 13D:
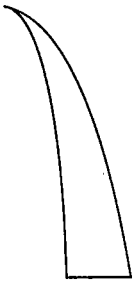
Figure 13E:
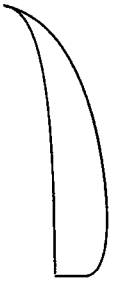
Figure 13F:
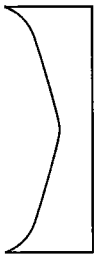
Figure 21:
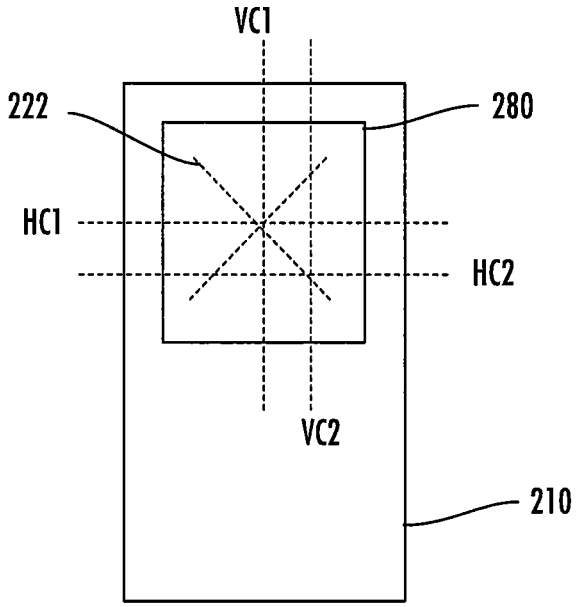
FIG. 21 is a schematic diagram illustrating example horizontal cross-sections and vertical cross-sections through an RF lens according to embodiments of the present invention.

FIGS. 13A-13F are schematic cross-sectional diagrams illustrating different example RF lens designs for the base station antennas according to embodiments of the present invention. FIGS. 13A-13E are vertical cross-sections of the depicted RF lenses while FIG. 13F is a horizontal cross-section. Herein, a "vertical cross-section" of an RF lens refers to a cross-section taken through the RF lens that is perpendicular to the plane defined by the horizon when an antenna including the RF lens is mounted for use and that is also perpendicular to a backplane that the RF lens is mounted in front of. Similarly, herein a "horizontal cross-section" of an RF lens refers to a cross-section taken through the RF lens that is taken along a plane that is parallel to the plane defined by the horizon when the antenna including the RF lens is mounted for normal use and that is also perpendicular to a backplane that the RF lens is mounted in front of. FIG. 21 is a front view of one of the RF lenses 280 of FIGS. 4A-4D mounted in front of a radiating element 222 that extends forwardly from a backplane 210 that illustrates the locations of representative vertical cross-sections VC1, VC2 and representative horizontal cross-sections HC1, HC2 as defined herein. Vertical cross-section VC1 and horizontal cross-section HC1 are each taken through the center of the radiating element 222, while vertical cross-section VC2 and horizontal cross-section HC2 are each taken along planes that do not pass through the center of the radiating element 222.

As can be seen in FIGS. 13A-13E, each of the depicted RF lenses has a vertical cross-section that has a generally convex shape. These convex vertical cross-sections cause the respective RF lenses to focus RF radiation in the elevation plane. As can also be seen in FIGS. 13A-13E, in each case the lower portion of the RF lens includes a greater amount of material than the upper portion of the RF lens, which further results in directing a portion of the upwardly-emitted radiation more downwardly.

In some embodiments, the RF lenses may be designed to spread out the antenna beam in the azimuth plane while reducing the amount of upwardly directed radiation in the elevation plane. In such embodiments, the RF lenses may be designed to have a generally concave horizontal cross-section so that the RF lens spreads out the antenna beam in the azimuth plane and a generally convex vertical cross-section, at least for the upper portion of the RF lens, so that the RF lens reduces the amount of radiation directed to at higher elevation angles.

For example, the RF lens of FIG. 13F has a horizontal cross-section that has a concave inner surface and a generally flat outer surface. This RF lens design will spread RF energy in the azimuth plane. Since in some embodiments the azimuth pattern is formed by the combination of four linear arrays that have azimuth pointing directions that are offset by 90° from each other, there may tend to be nulls in the azimuth pattern midway between the azimuth pointing direction of each linear array. By spreading out the azimuth pattern of each radiating element, these nulls may be reduced. The RF lens of FIG. 13F may have a more convex profile along the vertical cross-section, at least for the upper portion of the RF lens, in order to reduce the amount of upwardly-directed RF radiation. Various designs for RF lenses that focus/redirect RF radiation in the elevation plane while simultaneously defocusing (spreading) the RF radiation in the azimuth plane will be discussed in greater detail below with reference to FIGS. 16A-21.

Figure 15A:
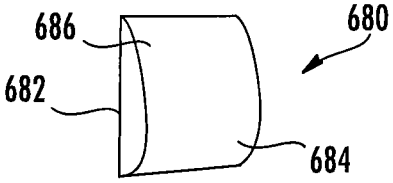
FIGS. 15A and 15B are schematic designs of an example lens according to further embodiments of the present invention.
Figure 15B:
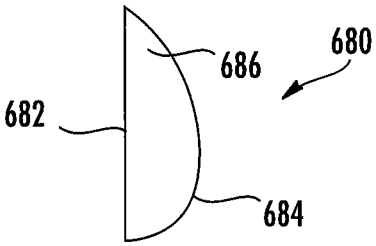
Figure 14A:
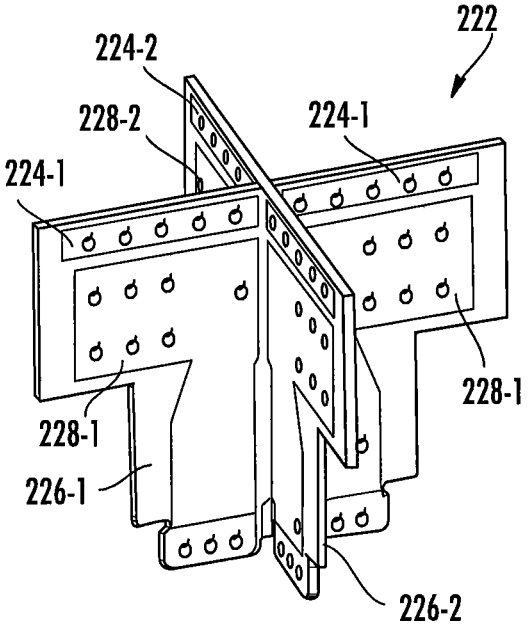
FIGS. 14A-14D are various views of a 5 GHz cross-dipole radiating element that may be used in certain of the base station antennas according to embodiments of the present invention.
Figure 14B:
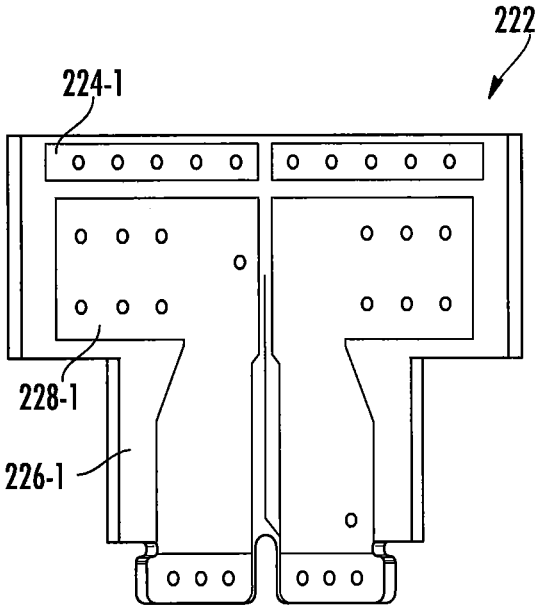
Figure 14C:
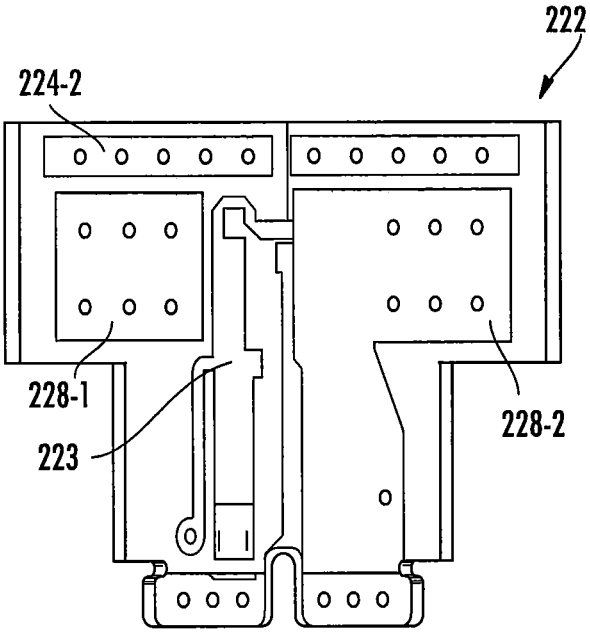
Figure 14D:
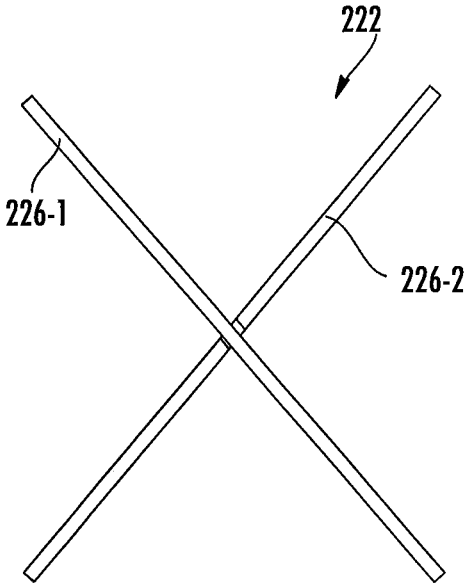

FIG. 15A is a schematic perspective view and FIG. 15B is a schematic side view of an example lens 680 according to further embodiments of the present invention. As shown in FIGS. 15A-15B, the RF lens 680 has a planar rear surface 682. A lower portion 684 of the RF lens 680 may include less material than an upper portion 686 of the RF lens 680. The planar back surface may simplify manufacture of the RF lens 680. The RF lens 680 may be used in place of any of the RF lenses in the above-described base station antennas according to embodiments of the present invention.

Pursuant to further embodiments of the present invention, base station antennas are provided that include RF lenses that focus radiation in the elevation plane and/or reduce the amount of upwardly directed radiation while simultaneously spreading (defocusing) the radiation in the azimuth plane to provide coverage in the azimuth plane that, for example, more closely resembles omnidirectional coverage.

As discussed above, various regulations may make it necessary to reduce the amount of upwardly directed radiation that is generated by small cell base station antennas that include linear arrays of radiating elements that operate in the UNII-1 frequency band. As is also discussed above, a reduction in the amount of upwardly directed radiation may be accomplished pursuant to embodiments of the present invention through the use of RF lenses that focus incident RF energy toward, for example, the equatorial plane and/or through the use of RF lenses that redirect some upwardly directed radiation from the radiating elements downwardly.

Figure 16A:
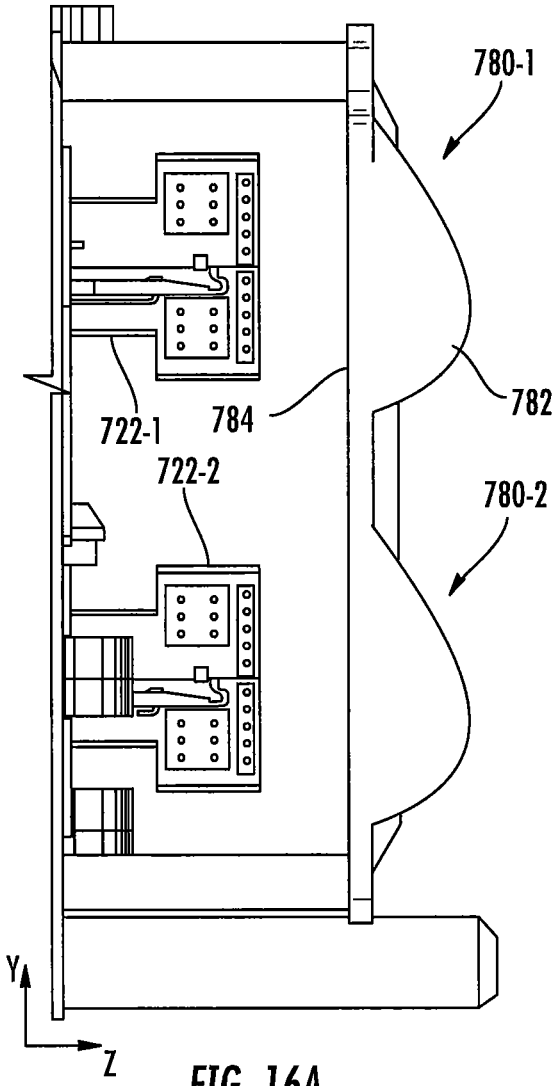
FIGS. 16A and 16B are a side view and a top view, respectively, of two radiating elements and respective associated RF lenses that are designed to focus radiation in the elevation plane and reduce upwardly directed radiation.
Figure 16B:
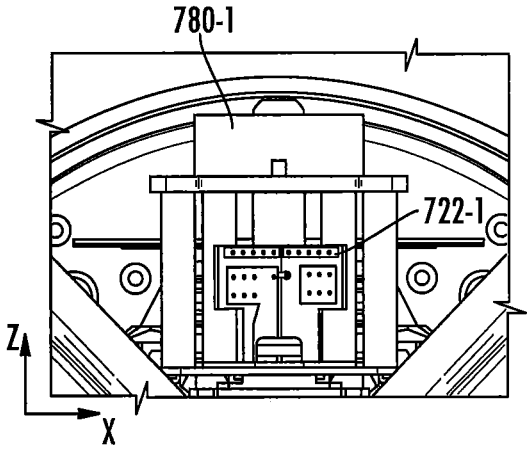
Figure 16C:
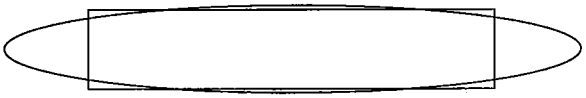
FIG. 16C is a schematic diagram illustrating how horizontal cross-sections of the RF lenses of FIGS. 16A-16B may approximate a convex shape.

FIGS. 16A and 16B are an enlarged side view and a top view, respectively, of two radiating elements 722-1, 722-2 and their associated RF lenses 780-1, 780-2 that further illustrate how the RF lenses according to embodiments of the present invention focus the RF radiation in the elevation plane and reduce upwardly directed radiation. The RF lenses 780 in FIGS. 16A-16B are similar to the RF lenses 280 of antenna 200, except that the RF lenses 780 have a generally plano-convex shape with a generally convex shape on the forward surface 782 of the RF lens 780 and a generally planar back surface 784, similar to the RF lenses 680 shown in FIGS. 15A-15B. As can be seen in FIG. 16A, the RF lens 780 has generally convex vertical cross-sections (i.e., cross-sections of the RF lenses 780 that are taken through the Y-Z plane). By forming the RF lens 780 to have a generally convex vertical profile, the RF lenses 780 will focus the RF radiation in the elevation plane toward, for example, the horizon or a point slightly below the horizon. In addition, each RF lens 780 is asymmetrical along the Y-axis, with a larger amount of lens material disposed in front of the lower portion of the radiating element 722 associated with the RF lens 780 (i.e., the respective radiating element 722 that is mounted behind each RF lens 780) in order to direct a larger amount of the RF radiation emitted by the radiating element 722 downwardly.

As shown in FIG. 16B, each RF lens 780 has roughly rectangular horizontal cross-sections (i.e., cross-sections of the RF lenses 780 that are taken through the Z-X plane). These rectangular horizontal cross-sections will tend to focus RF radiation in the azimuth plane, as a rectangle can be viewed as a quantized version of a convex lens, as shown in the schematic drawing of FIG. 16C. The RF lenses 280, 380 of base station antennas 200 and 300 of FIGS. 4A-4D and FIGS. 8A-8B will similarly focus the RF radiation in the azimuth plane. This focusing of the RF radiation in the azimuth plane may, however, tend to be disadvantageous in certain situations.

In particular, as discussed above, some of the small cell base station antenna according to embodiments of the present invention have RF lenses that are used with linear arrays that have radiating elements that are designed to transmit and receive signals in both the 3.5 GHz and 5 GHz frequency bands. In some of these embodiments, the linear arrays of radiating elements may be designed to generate a pair of antenna beams at 3.5 GHz, where each 3.5 GHz antenna beam has a generally peanut-shaped cross-sections in the azimuth plane and the two 3.5 GHz antenna beams are rotated 90 degrees with respect to each other to provide a pair of "orthogonal peanut-shaped antenna beams." When cross-polarized radiating elements are used, two such pairs of orthogonal peanut-shaped antenna beams are generated by the antenna, namely a pair at each of the two polarizations. A feed network having the design of the feed network 250 of FIG. 5A, but that is coupled to the 3.5 GHz radio as opposed to the 5 GHz radio, may be used to generate the two pairs of orthogonal peanut-shaped antenna beams. Together, the four antenna beams of the two pairs of orthogonal peanut-shaped antenna beams may approximate omnidirectional coverage.

Figure 20:
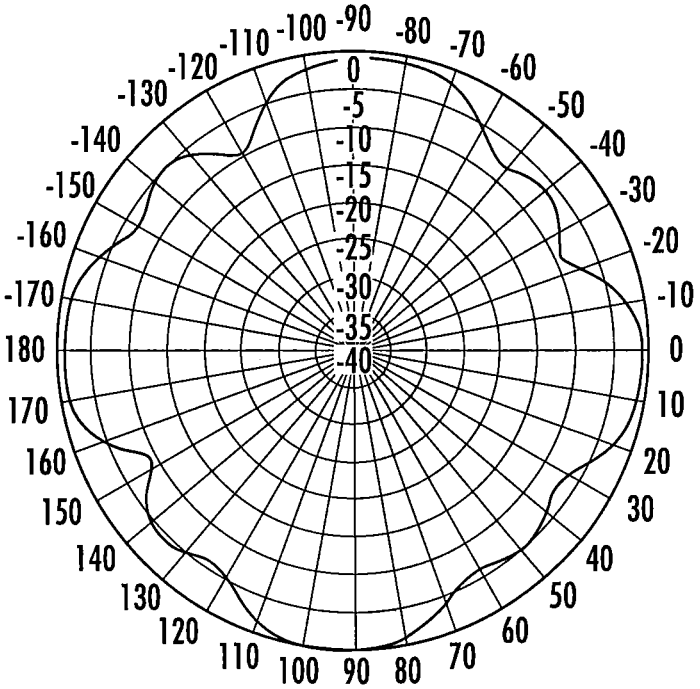
FIG. 20 is the modelled 5 GHz azimuth pattern for the base station antenna of FIGS. 4A-4D having the 5 GHz feed network of FIG. 5B.

At 5 GHz, the addition of RF lenses 280 to shape the elevation pattern may result in undesirable focusing of the RF radiation in the azimuth plane. This can be seen with respect to FIG. 20, which shows the 5 GHz azimuth pattern for the base station antenna 200 of FIGS. 4A-4D when an RF signal is fed with equal energy to all four 5 GHz linear arrays 220 using the feed network 250' of FIG. 5B. As can be seen in FIG. 20, the azimuth pattern has a rough quasi-omnidirectional shape, but the main lobes of the four linear arrays 220 are relatively narrow. As a result, in between the main lobes there is a significant dip in gain, which may be as large as 10 dB below the peak gain (see the pattern of FIG. 20 at −120°). If RF lenses 280 are added that further focus of the RF energy in the azimuth plane, then the dips in gain between the main lobes may become even larger, degrading the omnidirectional nature of the antenna pattern. In addition, the focusing of the main lobes also increases the gain of the main lobes. As noted above, in the 5 GHz UNII bands government regulations limit the gain of the antenna to −6 dBi. The increase in gain that results from the RF lenses 280 focusing the RF energy may cause the antenna 200 to exceed this limitation on gain, requiring other measures be taken to reduce the gain of the antenna 200 to the mandated level. Since the gain of the antenna must be kept below −6 dBi at all observation angles, fattening the main lobes tends to reduce the amount of ripple in the gain which facilitates staying under the −6 dBi gain requirement without having to add excessive amounts of insertion loss. Depending upon the system requirements and design goals, the RF lenses 280 may or may not actually defocus the radiation in the azimuth plane as compared to the case when RF lenses are not used, but the addition to the RF lenses 280 of some degree of concavity in the azimuth plane will defocus the radiation in the azimuth plane as compared to the case when RF lenses 280 are used that do not have such concavity (as may be the case when the goal is simply focusing and/or redirecting RF energy in the elevation plane).

Pursuant to further embodiments of the invention, base station antennas are provided that have RF lenses that are configured to focus radiation in the elevation plane while defocusing the radiation in the azimuth plane. These RF lenses may thus be used, for example, to facilitate compliance with the requirements for the UNII frequency band while improving the omnidirectional nature of the antenna beam(s) in the azimuth plane.

Figure 17A:
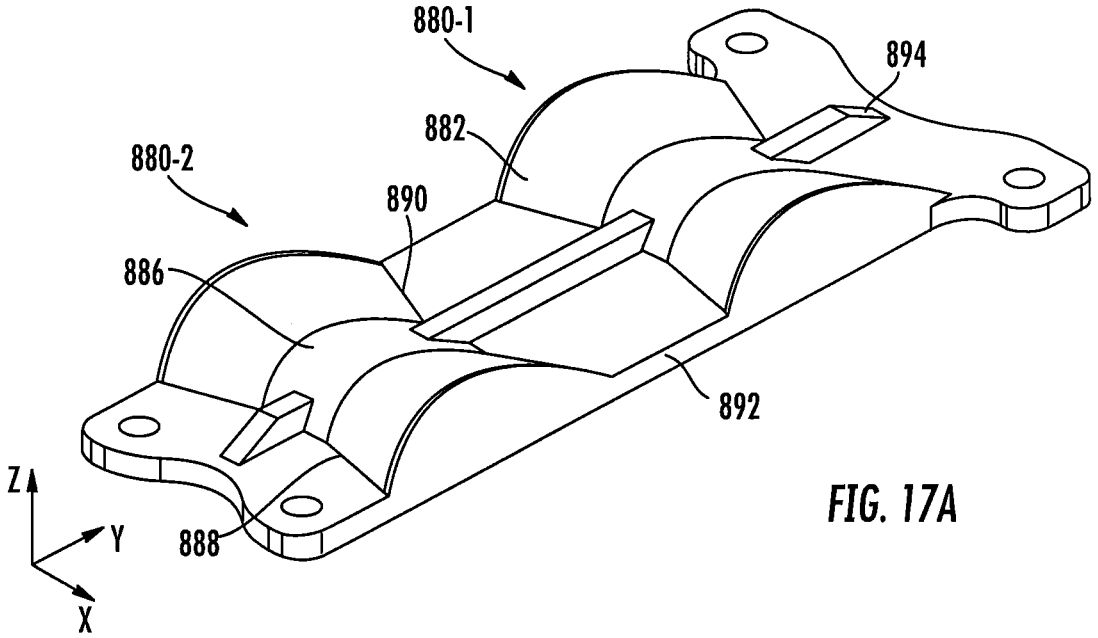
FIGS. 17A-17C are a perspective view, a side view and a top view of a pair of RF lenses that are configured to focus radiation in the elevation plane and reduce upwardly directed radiation while simultaneously defocusing radiation in the azimuth plane.
Figure 17B:
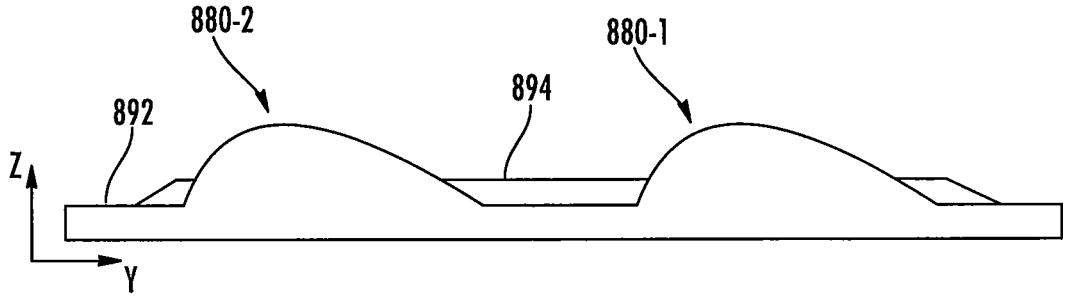
Figure 17C:
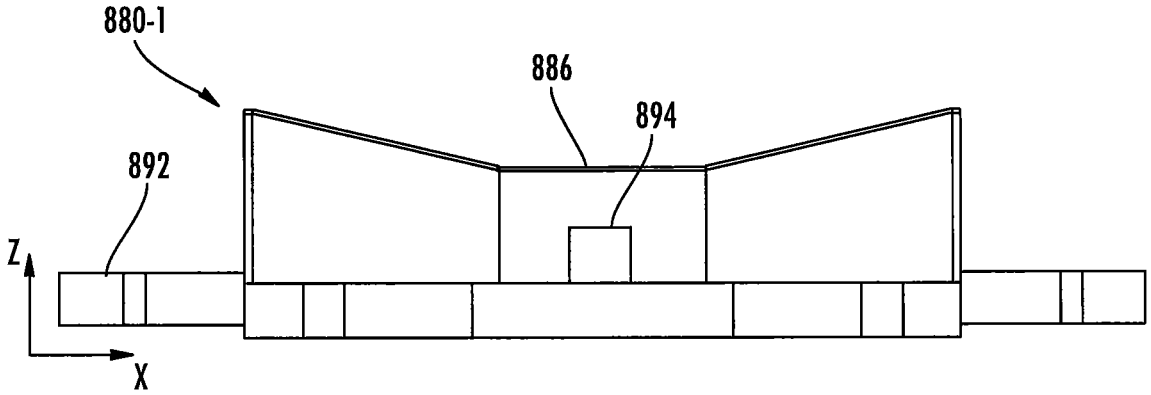

Referring now to FIGS. 17A-17C, RF lenses 880-1, 880-2 according to embodiments of the present invention are illustrated that may focus radiation in the elevation plane while defocusing the radiation in the azimuth plane. FIG. 17A is a perspective view of the pair of RF lenses 880, FIG. 17B is a side view of the pair of RF lenses 880, and FIG. 17C is a top view of the pair of RF lenses 880.

As shown in FIGS. 17A-17C, each RF lens 880 has a generally convex shape along the Y-axis (i.e., along the elevation plane), while having a generally concave profile along the X-axis (i.e., along the azimuth plane). Accordingly, the vertical cross-sections of each RF lens 880 have generally convex shapes and the horizontal cross-sections of each RF lens 880 have generally concave shapes. The RF lenses 880 may be formed by modifying the RF lens 780 of FIGS. 16A-16B so that it has less lens material in a vertically extending region 886 (i.e., a region extending along the Y-axis) that passes through the center of the RF lens 880, as can be seen in FIGS. 17A and 17C. As shown in FIGS. 17A-17B, each RF lens 880 may also be asymmetric along the Y-axis, with a lower half of each RF lens 880 including a larger amount of lens material than an upper half of the RF lens 880. The asymmetric shape of the RF lens 880 may act to direct a larger amount of the radiation emitted by a radiating element that is associated with the RF lens 880 downwardly. As can best be seen in FIG. 17A, each RF lens 880 may also have a curved lower surface 888 such that outer lower portions of each RF lens 880 extend further downwardly than a central lower portion of the RF lens 880. The upper surface 890 of each RF lens 880 may be curved in the opposite direction.

In the embodiment of FIGS. 17A-17C, two RF lenses 880 are formed on a common substrate 892. It will be appreciated that in other embodiments the common substrate 892 may be omitted or that more than two RF lens 880 may be formed on the common substrate 892. The substrate 892 may be formed of the same material as the RF lenses 880 in some embodiments. A support rib 894 may be provided to increase the rigidity of the substrate 892 to reduce warping.

Figure 18A:
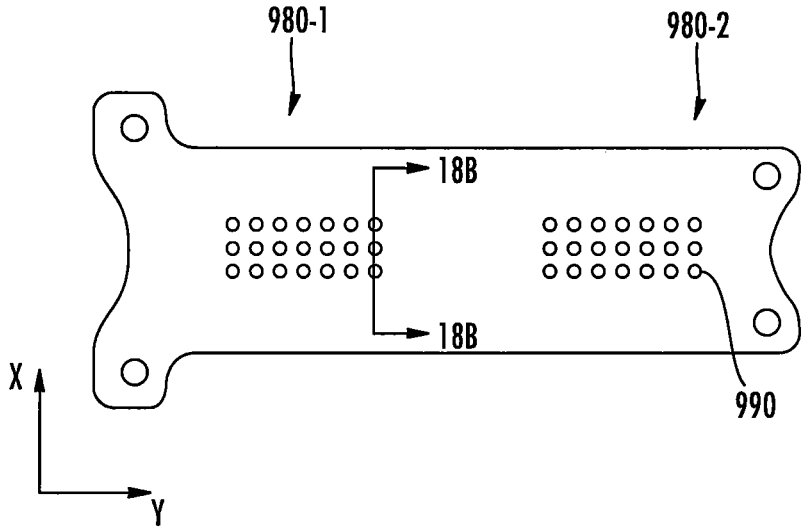
FIGS. 18A and 18B are a front view and a cross-sectional view, respectively, of a pair of RF lenses formed of materials having different dielectric constants that are configured to focus radiation in the elevation plane and reduce upwardly directed radiation while simultaneously defocusing radiation in the azimuth plane.
Figure 18B:
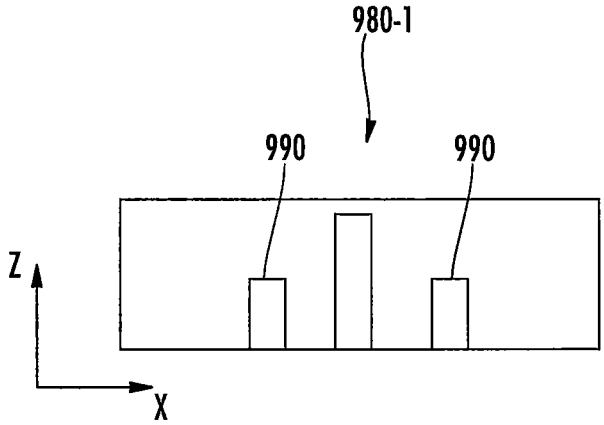
Figure 18C:
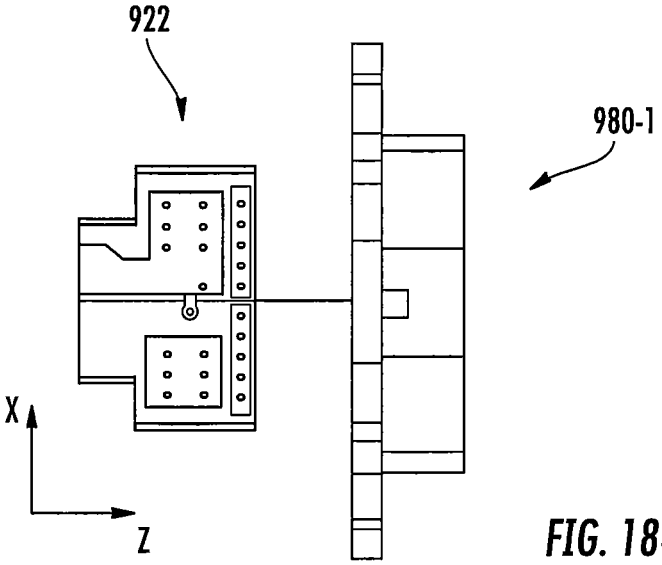
FIG. 18C is a top view of one of the RF lenses of FIGS. 18A-18B illustrating how the RF lens is positioned in front of an associated radiating element.
Figure 18D:
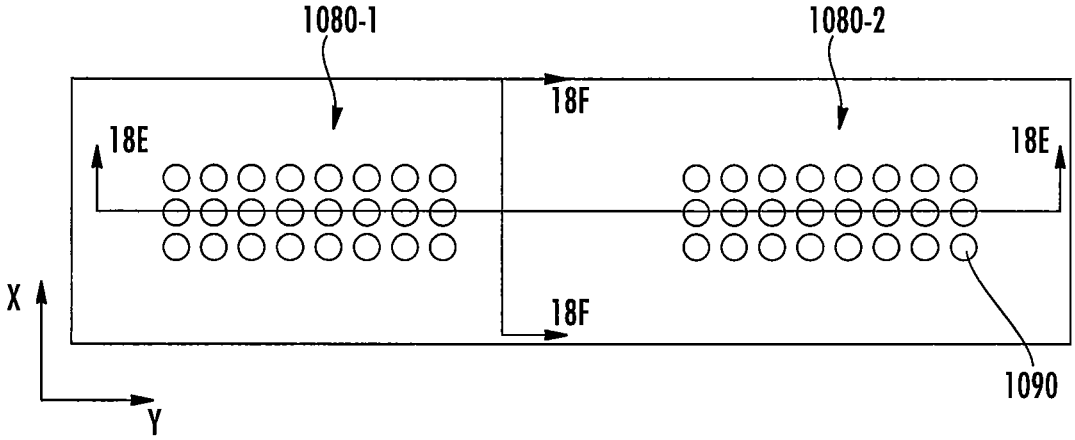
FIGS. 18D-18F are a front view, a vertical cross-sectional view and a horizontal cross-sectional view, respectively, of another pair of RF lenses that are formed of materials having different dielectric constants.
Figure 18E:
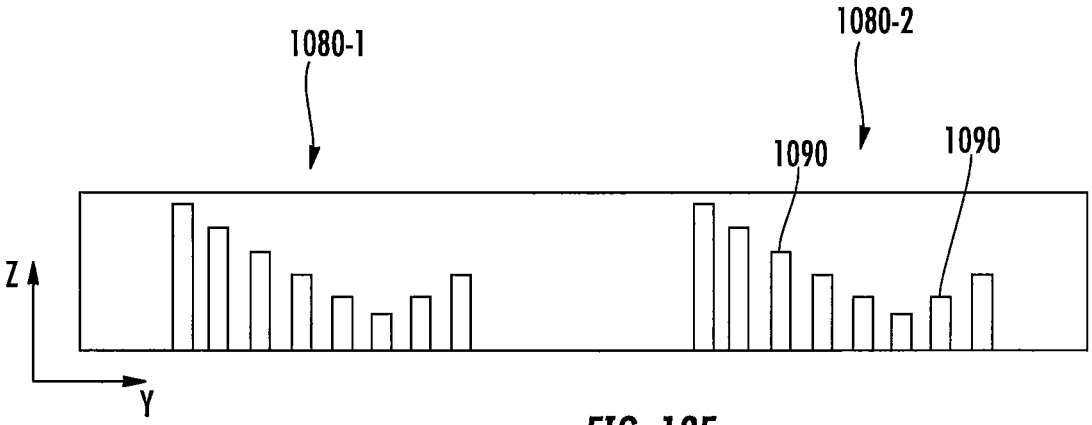
Figure 18F:
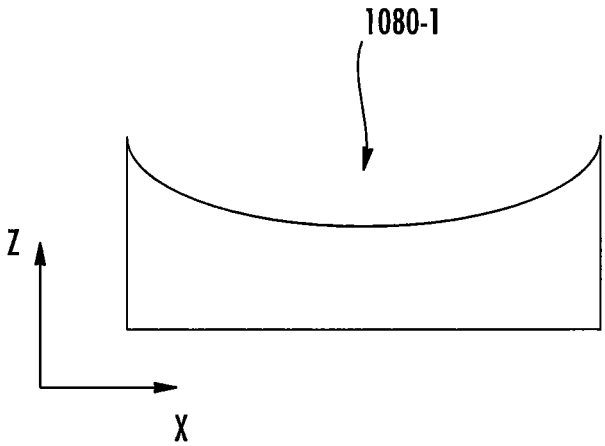

Designing the RF lens 880 to have a generally concave horizontal cross-sections and generally convex vertical cross-sections is one way of providing an RF lens that focuses RF radiation in the elevation plane while defocusing the RF radiation in the azimuth plane. The RF lens 880 may be formed of a single material and hence may have a uniform dielectric constant. It will be appreciated, however, that other techniques may be used to provide an RF lens that focuses RF radiation in the elevation plane while defocusing the RF radiation in the azimuth plane. For example, FIGS. 18A-18C illustrate a pair of RF lenses 980 that use a first alternative technique for achieving this effect, while FIGS. 18D-18F illustrate a pair of RF lenses 1080 that use a second alternative technique for achieving this effect. In each case, the RF lenses 980, 1080 are formed using materials having at least two different dielectric constants and differences in the effective dielectric constant of different portions of the RF lenses are used to focus and/or defocus RF radiation in a desired manner.

Referring first to the embodiment of FIGS. 18A-18C, FIGS. 18A and 18B are a front view and a cross-sectional view, respectively, of the pair of RF lenses 980. FIG. 18C is a top view of one of the RF lenses 980 illustrating how it is positioned in front of an associated radiating element 922.

Referring to FIGS. 18A-18C, instead of the reducing the Z-axis thickness of a central portion of the RF lens that extends along the Y-axis (i.e., in the vertical direction through the RF lens 980) as is done with the RF lens 880, the same effect may be achieved by forming an RF lens 980 using lens material that has a non-uniform dielectric constant. In the example embodiment of this approach shown in FIGS. 18A-18C, the RF lens 980 may be formed of a material having a first dielectric constant and the dielectric constant of the RF lens 980 may be made variable by forming air-filled holes 990 through portions of the first dielectric material. The RF lens 980 thus may be viewed as being formed of two dielectric materials, namely the first dielectric material and air which acts as a second dielectric material. Since air has a dielectric constant of 1, whereas the first dielectric material used to form the RF lens 980 will have a higher dielectric constant (e.g., between 1.5 and 4.5), the "effective thickness" of the portion of the RF lens 980 having air holes 990 will be reduced in comparison to the remainder of the RF lens 980. Herein, the "effective thickness" of a first portion of an RF lens that is formed of a plurality of materials having different dielectric constants is the physical thickness of an RF lens formed of the one of the plurality of materials that has the highest dielectric constant that would bend RF radiation the same amount as the first portion of the RF lens. Thus, the "effective thickness" takes into account how the use of lower dielectric constant material reduces the ability of portions of an RF lens to bend the RF radiation. The effect of the air holes 990—which have a low dielectric constant—is to reduce the effective thickness of the RF lens 980 in the region where the air holes 990 are provided. Another way of viewing the impact of the air holes (or other dielectric materials that have a different dielectric constant than a base material of the RF lens) is that the first and second dielectric materials having first and second dielectric constants may be viewed as a single dielectric material that has an "effective dielectric constant" that is equivalent to the blended combination of the first and second dielectric materials. Thus, the "effective dielectric constant" is the dielectric constant of an RF lens that has the same shape that would bend the RF radiation the same amount as the RF lens that is formed of the first and second dielectric materials.

As shown in FIG. 18A, the air holes 990 extend in a generally vertical direction through the center of the RF lens 980. Thus, the effective thickness of the portion of the RF lens 980 that extends vertically through the center of the RF lens 980 is reduced. Moreover, as shown in FIG. 18B, the length of each air hole 990 in the Z-direction (also referred to herein as the "depth" of the air holes 990) may be varied so that horizontal cross-sections through the RF lens 980 will have effective thicknesses that have concave shapes in terms of the ability of the RF lens 980 to bend RF radiation. The RF lens 980 may have a cross-section along the Y-axis having, for example, a constant physical thickness (this can be seen in FIG. 18B), in contrast to the RF lens 880 of FIG. 18A, as the air holes 990 give the RF lens 990 its concave property in the azimuth plane. In other embodiments, characteristics of the air holes 990 other than the length thereof may be varied. For example, in another embodiment, the area of vertical cross-sections taken along longitudinal axes of respective ones of the air holes 990 may be varied (e.g., for circular air holes 990, the diameter of the air holes 990 may be varied) in order to vary the amount of lower dielectric constant material included in different portions of the RF lens. As yet another example, the density of the air holes 990 (i.e., the number of air holes 990 per unit area) may be varied in different locations throughout the RF lens 980.

The RF lenses 980 of FIGS. 18A-18C may have the physical shape of the RF lens 680 of FIGS. 15A-15B, which has a generally convex vertical profile that focuses the RF radiation in the elevation plane. The air filled holes 990 that are included in each RF lens 980 give each RF lens 980 horizontal cross-sections that have effective thickness with concave shapes that cause the RF lens 980 to defocus the RF radiation in the azimuth plane. FIGS. 18D-18F illustrate another RF lens 1080 which has horizontal cross-sections that have a generally concave physical shape in order to defocus the RF radiation in the azimuth plane, and which further includes air filled holes 1090 which are provided so that a vertical cross-section of the RF lens will effectively have a convex shape in order to focus the RF radiation in the elevation plane.

In the above-described embodiments of FIGS. 18A-18C and FIGS. 18D-18F, the holes 990, 1090 that are formed through the respective RF lenses 980, 1080 are filled with air. The air may be considered to be a second RF lens material where the two materials used to form the RF lenses 980, 1080 (namely the block of dielectric material and the air in the air holes 990, 1090) have different dielectric constants. It will be appreciated that the second dielectric material may be materials other than air, and that the RF lens may be formed using more than two different materials in other embodiments. For example, in another embodiment, RF lenses may be provided that are formed of vertically extending strips of different dielectric materials, where each strip of dielectric material has a different dielectric constant to provide an RF lens having horizontal cross-sections with generally concave effective thicknesses or to provide an RF lens having vertical cross-sections with generally convex effective thicknesses.

Figure 19A:
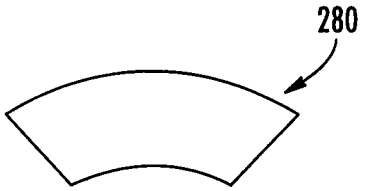
Figure 19B:
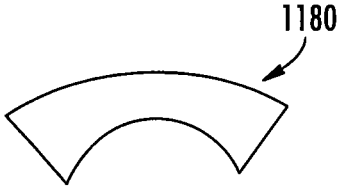
FIG. 19B is a schematic diagram illustrating how the generally convex horizontal cross-section of FIG. 19A may be modified to have a concave horizontal cross-section for purposes of defocusing the RF radiation in the azimuth plane.

FIGS. 19A-19B illustrate yet another technique for defocusing the RF radiation in the azimuth plane. In particular, FIG. 19A is a horizontal cross-section (i.e., a cross-section in the azimuth plane) through the RF lens 280 of FIGS. 4A-4D. As shown in FIG. 19A, the RF lens 280 has an annular cross-section that has a uniform thickness. Such an RF lens will operate as a convex lens in the azimuth plane. FIG. 19B illustrates another RF lens 1180 that has a similar horizontal cross-section. However, in the RF lens 1080, the radius of the outer side of the horizontal cross-section is increased while the radius of the inner side of the horizontal cross-section is decreased. As a result of these changes, the RF lens 1180 has a generally concave shape in the azimuth plane. The RF lens 1180 may have generally convex vertical cross-sections, and thus the RF lens 1180 may focus RF radiation in the elevation plane while defocusing the RF radiation in the azimuth plane. It will be appreciated that it is not necessary to increase both the radius of the outer side of the horizontal cross-section and to decrease the radius of the inner side of the horizontal cross-section in order to convert the RF lens 280 to the an RF lens that has a generally concave shape in the azimuth plane; instead, it is only necessary to do one or the other.

It will be appreciated that a tradeoff may exist between the ability to focus RF radiation in the elevation plane while simultaneously defocusing RF radiation in the azimuth plane. In particular, modifying an RF lens such as RF lens 280 so that the RF lens has a generally concave shape in the azimuth plane may involve making a center portion of the RF lens "thinner" by reducing the amount of lens material and/or by reducing the dielectric constant of the material in the center portion of the RF lens. This reduction in the physical and/or effective thicknesses of the center portion of the RF lens reduces the ability of the RF lens to focus the RF radiation in the elevation plane, as such focusing is achieved by increasing the thickness of the RF lens, particularly in the center portion thereof. As such, the concept of providing an RF lens that focuses RF radiation in the elevation plane while defocusing the RF radiation in the azimuth plane is generally counterintuitive as the two goals may be at odds with one another. However, the inventors have appreciated that it is possible to achieve both focusing of the RF radiation in the elevation plane and defocusing of the RF radiation in the azimuth plane by, for example, substantially thickening the vertically-extending outer portions of an RF lens while providing less lens material in the vertically-extending central strip of lens material, which provides a concave shape in the azimuth plane while also providing a generally convex shape in the elevation plane. Moreover, with respect to the somewhat unique requirements for the UNII band, the RF lens may improve the elevation pattern in two different ways, namely by (1) focusing the RF energy generally toward or below the horizon and (2) redirecting upwardly directed radiation downward by having an asymmetric RF lens shape. The redirection of the upwardly-directed RF energy downward may be accomplished by increasing the amount of lens material in the lower portion of the RF lens as compared to the upper portion of the RF lens, which may be less at odds with respect to providing an RF lens having a generally concave horizontal cross-section. Accordingly, embodiments of the present invention provide base station antennas having RF lenses that may improve the shape of the antenna beams in both the azimuth and elevation planes.

It will be appreciated that the RF lens described above that focus RF radiation in the elevation plane while defocusing RF radiation in the azimuth plane may be used in any of the small cell base station antenna disclosed herein.

It will appreciated that many modifications may be made to the antennas described above without departing from the scope of the present invention. As one example, simpler feed networks may be used in other embodiments. For example, the feed network 350 illustrated in FIG. 9 include phase shifters 358 which allow electronic adjustment of the elevation angle of the resulting antenna beams 392. In other embodiments, the remote electronic downtilt capabilities may be omitted entirely. In such embodiments, the phase shifters 358 may be replaced with simple power splitter/combiners that do not perform any phase shifting (and a fixed phase taper may or may not be built into the feed network). Other of the feed networks described above omit phase shifters. It will be appreciated that in further embodiments phase shifters could be added to any of these feed networks to provide remote electronic downtilt capabilities. Thus, it will be appreciated that a wide variety of different feed networks may be used depending upon the specific capabilities implemented in the antennas according to embodiments of the present invention.

As another example, in the above described embodiments RF lenses are provided in front of each 5 GHz radiating element. It will be appreciated that this not be the case, and that RF lenses may be omitted in front of some radiating elements. It will likewise be appreciated that larger lenses may be used in some embodiments that are placed in front of multiple radiating elements. Such multi-element RF lenses may be appropriately shaped to re-direct some of the upwardly-emitted radiation from each of the multiple radiating elements.

Additionally, while embodiments of the present invention have primarily been described above with respect to antennas that have 5 GHz linear arrays that operate in the UNII-1 frequency band, it will be appreciated that the RF lenses described herein may be used on antennas that operate in other frequency bands (such as the WCS frequency band) where it is necessary to limit the amount of RF radiation that is emitted in a certain direction. With the WCS band, the requirement is to limit the amount of energy that is emitted at elevation angles of more than 45° below the horizon. The same RF lens based techniques discussed herein may be used to redirect energy from such low elevation angles toward the horizon.

As another example, the above embodiments of the present invention are implemented in base station antennas having tubular reflector assemblies that have rectangular horizontal cross-sections. In other embodiments, the tubular reflector may have other shapes of horizontal cross-sections, such as triangular or hexagonal cross-sections. In still other embodiments, the antennas may alternatively be panel antennas in which all of the linear arrays are mounted on a common reflector and have radiating elements that point in the same direction.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some elements may not be to scale.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention.

That which is claimed is:

1. A base station antenna, comprising:

a plurality of linear arrays of radiating elements; and a plurality of radio frequency ("RF") lens, each RF lens mounted forwardly of a corresponding one of the radiating elements, wherein each RF lens is asymmetrical about a horizontal axis that bisects its corresponding one of the radiating elements wherein a first of the linear arrays of radiating elements is mounted opposite a second of the linear arrays of radiating elements so that the first and second linear arrays of radiating elements point in opposite directions, and wherein the first and second of the linear, arrays of radiating elements are mounted on opposed backplanes of a tubular reflector assembly that extends along a generally vertical longitudinal axis.

2. The base station antenna of claim 1, wherein each RF lens is configured to re-direct a portion of an RF energy emitted by its corresponding one of the radiating elements downwardly.

3. The base station antenna of claim 1, wherein each RF lens is configured to defocus an RF radiation in the azimuth plane.

4. A base station antenna, comprising:

a first backplane;

a second backplane that is angled with respect to the first backplane;

a first vertically-extending linear array of radiating elements extending forwardly from the first backplane, the radiating elements in the first vertically-extending linear array of radiating elements coupled to a first radio frequency ("RF") port;

a second vertically-extending linear array of radiating elements extending forwardly from the second backplane, the radiating elements in the second vertically-extending linear array of radiating elements coupled to a second RF port; and err RF lens mounted forwardly of a first of the radiating elements in the first vertically-extending linear array, wherein a first portion of the RF lens that is below a horizontal axis that is perpendicular to the first backplane and that extends through a center of the first of the radiating elements has a greater average thickness in the direction of the horizontal axis than a second portion of the RE lens that is above the horizontal axis.

5. The base station antenna of claim 4, wherein the RF lens is configured to increase an azimuth beamwidth of an antenna beam emitted by the first of the radiating elements.

6. A base station antenna, comprising a plurality of linear arrays of radiating elements; and a plurality of radio frequency ("RF") lens, each RF lens mounted forwardly of a corresponding one of the radiating elements, wherein each RF lens is asymmetrical about a horizontal axis that bisects its corresponding one of the radiating elements, wherein each RF lens is configured to re-direct a first portion of RF radiation emitted by its corresponding one of the radiating elements downwardly, and wherein the first portion exceeds a second portion of the RF radiation emitted by its corresponding one of the radiating elements that is re-directed upwardly by the RE lens.

7. A base station antenna, comprising:

a plurality of linear arrays, of radiating elements; and a plurality of radio frequency ("RF") lens, each RF lens mounted forwardly of a corresponding one of the radiating elements, wherein each RF lens is asymmetrical about a horizontal axis that bisects its corresponding one of the radiating elements, wherein each RF lens is configured to re-direct a portion of respective RE radiation, emitted by its corresponding one of the radiating elements downwardly so that a first peak emission of RF energy through the combination of the RF lens and its corresponding one of the radiating elements at elevation angles that area greater than 30° above a boresight pointing direction of the corresponding one of the radiating elements is less than a second peak, emission of RE energy through the combination of the RE lens and its corresponding one of the radiating elements at elevation angles that are less than 30° above the boresight pointing direction of the corresponding one of the radiating elements.

8. A base station antenna, comprising:

a first backplane that extends along a vertical axis when the base station antenna is mounted for use;

a first radiating element mounted to extend forwardly from the first backplane; and a first radio frequency ("RF") lens mounted forwardly of the first radiating element, wherein the first RF lens is configured to focus RF energy emitted by the first radiating element in an elevation plane while defocusing, the RF energy emitted by the first radiating element in an azimuth plane.

9. The base station antenna of claim 8, wherein a horizontal cross-section of the first RF lens that is taken through a horizontal center of the first radiating element has a generally concave shape.

10. The base station antenna of claim 9, wherein a vertical cross-section of the first RF lens that is taken through a vertical center of the first radiating element has a generally convex shape.

11. The base station antenna of claim 8, wherein the first RE lens is asymmetric about a horizontal plane that extends through the center of the first RF lens, with a first portion of the first RE lens that is below the horizontal plane having a greater amount of lens material than a second portion of the first RE lens that is above the horizontal plane.

12. The base station antenna of claim 8, wherein a middle portion of a horizontal cross-section of the first RF lens that is taken through a horizontal center of the first radiating element has a first effectiveness thickness that is less than a second effective thickness of, a first outer portion of the first RF lens that is on one side of the middle portion along the horizontal cross-section and that is also less than a third effective thickness of a second outer portion of the first RE lens that is on an opposite side of the middle portion along the horizontal cross-section.

13. The base station antenna of claim 8, wherein a central portion of the first RF lens includes a plurality of holes.

14. The base station antenna of claim 8, further comprising a second radiating element mounted to extend forwardly from the first backplane and a second RF lens mounted forwardly of the second radiating element, the first and second radiating elements being coupled to a common radio port via a feed network, wherein the second RF lens is configured to focus RF energy emitted by the second radiating element in the elevation plane while defocusing the RF energy emitted by the second radiating element in the azimuth plane.

15. The base station antenna of claim 14, wherein the first radiating element is stacked above the second radiating element so that the first and second radiating elements form at least a portion of a first linear array of radiating elements.

16. The base station antenna of claim 15, further comprising a second backplane, a third backplane and a fourth backplane that together with the first backplane define a tubular reflector assembly that extends along a generally vertical longitudinal axis, wherein a second linear array of radiating elements is mounted to extend forwardly from the second backplane, a third linear array of radiating elements is mounted to extend forwardly from the third backplane and a fourth linear array of radiating elements is mounted to extend forwardly from the fourth backplane, each of the radiating elements in the second through fourth linear arrays including an associated RF lens.

17. A base station antenna, comprising:

a first backplane that extends along a vertical axis when the base station antenna is mounted for use;

a first radiating element mounted to extend forwardly from the first backplane; and a first radio frequency ("RF") lens mounted forwardly of the first radiating element, wherein a dielectric thickness of the first RF lens has a generally concave shape along a horizontal cross-section taken through a horizontal center of the first radiating element, and a generally convex shape along a vertical cross-section taken through a vertical center of the first radiating element.

18. The base station antenna of claim 17, wherein the first RF lens is configured to focus RF radiation emitted by the first radiating element in an elevation plane while defocusing the RF radiation emitted by the first radiating element in an azimuth plane.

19. The base station antenna of claim 17, wherein a central portion of the first RF lens includes a plurality of holes.

20. The base station antenna of claim 19, wherein the plurality of holes extend vertically through the central portion of the first RE lens.

* * * * *